US008083334B2

(12) United States Patent
Nozawa

(10) Patent No.: US 8,083,334 B2
(45) Date of Patent: Dec. 27, 2011

(54) LIQUID STORAGE CONTAINER AND REFILLING METHOD USING THE SAME

(75) Inventor: Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 957 days.

(21) Appl. No.: 12/048,914

(22) Filed: Mar. 14, 2008

(65) Prior Publication Data

US 2008/0225093 A1 Sep. 18, 2008

(30) Foreign Application Priority Data

Mar. 14, 2007 (JP) ..... 2007-064519

(51) Int. Cl.
*B41J 2/175* (2006.01)

(52) U.S. Cl. ..... 347/86

(58) Field of Classification Search ..... 347/84, 347/86, 87; 237/85; 141/114; 222/92, 105, 222/206, 574; 383/123, 126
See application file for complete search history.

(56) References Cited

U.S. PATENT DOCUMENTS

| | | | | |
|---|---|---|---|---|
| 5,221,935 | A * | 6/1993 | Uzita | 347/36 |
| 6,220,702 | B1 * | 4/2001 | Nakamura et al. | 347/86 |
| 6,582,068 | B2 * | 6/2003 | Ishizawa et al. | 347/85 |
| 7,293,863 | B2 | 11/2007 | Seino et al. | |
| 2008/0030558 | A1 | 2/2008 | Seino et al. | |

FOREIGN PATENT DOCUMENTS

| | | | |
|---|---|---|---|
| CN | 1657296 | A | 8/2005 |
| JP | 5-028640 | U | 4/1993 |
| JP | 2000-238278 | A | 9/2000 |
| JP | 2000-238291 | A | 9/2000 |
| JP | 2002-19136 | A | 1/2002 |
| JP | 2002-361882 | A | 12/2002 |
| JP | 2004-167685 | A | 6/2004 |
| JP | 2005-199516 | A | 7/2005 |

* cited by examiner

*Primary Examiner* — Anh T. N. Vo
(74) *Attorney, Agent, or Firm* — Sughrue Mion, PLLC

(57) ABSTRACT

A liquid storage container includes: a liquid storage bag which at least includes first and second sealing joint portions obtained by joining flexible members in a sealing manner; a liquid lead-out member which is mounted on the first sealing joint portion of the liquid storage bag; a case which holds the liquid storage bag and the liquid lead-out member and supports the liquid lead-out member; and a reception portion which is formed in the case to receive the second sealing joint portion displaced when a liquid is led out from the liquid storage bag.

26 Claims, 16 Drawing Sheets

LIQUID STORAGE CONTAINER AND REFILLING METHOD USING THE SAME

BACKGROUND

1. Technical Field

The present invention relates to a liquid storage container such as an ink cartridge and a method of refilling a liquid into the liquid storage container.

2. Related Art

In the past, as a liquid ejecting apparatus for ejecting liquid drops from a nozzle of a liquid ejection head, an ink jet printer was known. Some ink jet printers have an ink supply system of an off-carriage type for mounting the ink cartridge on a position other than a carriage. In a case where the ink supply system of the off-carriage type is mounted, a large capacity ink cartridge can be provided to perform printing on a large sheet. Moreover, the ink cartridge can be not mounted to reduce the size of the carriage, thereby miniaturizing and sliming the ink jet printer.

In the ink supply system of the off-carriage type, for example, the ink cartridge is mounted on a printer body. Ink is supplied from the ink cartridge to a sub-tank or a printing head mounted in the carriage through an ink supply tube.

Such an ink cartridge is disclosed in JP-A-2002-19136. In the ink cartridge, an ink pack is held in a lower case, an elastic material such as foamed polystyrene is mounted, and an opening of the lower case is sealed by a sealing film to fix an upper case.

Since the ink pack is deformed due to a pressurizing air with lead-out of ink, the entire length of the ink pack full of the ink is considerably different from that of the ink pack in which the ink is empty. Accordingly, the difference in the entire lengths becomes considerable if the ink pack has a more capacity. For example, the difference in the entire lengths is about 1 cm. The rear end of the ink pack is a sealing joint portion, and it is more difficult for the rear end of the ink pack to be formed, comparing to an area which is not adhered.

In the past, the difference in the entire lengths of the ink packs is not required to be taken into consideration to design the size of the lower case since the ink pack full of ink is received in the lower case and the difference in the entire lengths can be ignored if the capacity of the ink pack is small.

However, if the capacity of the ink pack becomes increased and the entire length of the ink pack becomes expanded with the lead-out of ink from the ink pack, the rear end of the sealing joint portion may collide with the inner wall of the lower case. In this case, a free space of the rear end of the sealing joint portion is insufficient. Accordingly, since the sealing joint portion is not freely displaced, the free displacement of the ink pack may deteriorate. As a result, an amount of remaining ink becomes irregular when the deformation of the ink pack deteriorates.

Recently, the liquid level detecting unit is mounted in the ink cartridge. However, if the amount of remaining ink becomes irregular due to a difference in the deformation of the ink pack, it is difficult to design a threshold value of end detection or near end detection in the liquid level detecting unit. As a result, since the amount of ink remaining in the ink pack becomes large, it is not desired for a user.

The sealing joint portion displaced at the time the ink pack is deformed is not limited to the rear end of the ink pack, but may be adhered to both edges in accordance with an ink pack type. The sealing joint portions of both the edges can be also displaced when the ink is led out.

SUMMARY

An advantage of some aspects of the invention is that it provides a liquid storage container capable of freely deforming a liquid storage bag when a liquid is led out.

Moreover, an advantage of some aspects of the invention is that it provides a method of refilling a liquid into the liquid storage container capable of freely deforming the liquid storage bag even after the refilling when the used liquid storage container is refilled.

According to an aspect of the invention, there is provided a liquid storage container including: a liquid storage bag which at least includes first and second sealing joint portions obtained by joining flexible members in a sealing manner; a liquid lead-out member which is mounted on the first sealing joint portion of the liquid storage bag; a case which holds the liquid storage bag and the liquid lead-out member and supports the liquid lead-out member; and a reception portion which is formed in the case to receive the second sealing joint portion displaced when a liquid is led out from the liquid storage bag.

With such a configuration, an inner volume of the liquid storage bag decreases when the liquid is led out from the liquid storage bag. Accordingly, the first sealing joint portion supported by the case and connected to the liquid lead-out member is not moved, but the second sealing joint portion is displaced with the decrease in the inner volume. The displaced second sealing joint portion is received in the reception portion formed in the case. Accordingly, the free displacement of the second sealing joint portion allows the liquid storage bag to be freely displaced, thereby reducing irregularity of an amount of remaining liquid.

In the liquid storage container having the above-described configuration, the reception portion may have a guide portion for guiding the second sealing joint portion in a second direction other than a first direction which is a straight-forward direction. The reception portion can receive the second sealing joint portion which is moved in a straight-forward direction, but a problem that the case has to be larger arises. However, if the second sealing joint portion which has a rigid property and is moved in the straight-forward direction is moved in a second direction other than a first direction as the straight-forward direction, it is not necessary to increase the size of the case or the size of the case can be enlarged a little.

In other words, in a state in which the reception portion is not present, the first direction may be defined as a direction which is displaced in an extension line of the second sealing joint portion having the straight line shape. In addition, a second direction may be defined as a direction intersecting the first direction. In this case, the second direction may be one of a straight-forward direction, a curved direction, a bending direction in which plural straight lines with a predetermined intersecting angle are combined, and a complex direction in which two or more of the directions are combined. With such a configuration, the size of the case can be prevented from being enlarged or can be decreased.

In the liquid storage container having the above-described configuration, the second sealing joint portion may be bent or curved while making abutting contact with the guide in a state in which the liquid is not led out from the liquid storage bag. If the second sealing joint portion is curved or bent before the displacement, the size of the case can be decreased.

In the liquid storage container having the above-described configuration, the liquid storage bag may be formed in a rectangular shape in plan view, and the second sealing joint portion may be formed in a second edge opposite a first edge in which the first sealing joint portion is formed. That is, the first edge is the front end in which the case is supported and the second edge is the rear end of the liquid storage container. Normally, a job of initially filling a liquid into the liquid storage container is performed by opening the rear end before the sealing. Accordingly, the liquid storage bag normally has the second sealing joint portion on the rear thereof. Since the second sealing joint portion is positioned in the rear end in the longitudinal direction, the displacement is large. However, the reception receiving the rear end can guarantee free displacement of the liquid storage bag. Instead of that, the second sealing joint portion may be formed in the second edge intersecting the first edge in which the first sealing joint portion is formed.

In the liquid storage container having the above-described configuration, a relation of $S0<S1$ may be satisfied, assuming that in a state in which the liquid of the liquid storage bag is led out from the liquid storage bag, a distance between a reference position at which an end of the second sealing joint portion is positioned and a wall portion of the case disposed at the end of the first direction is $S0$, and in a state in which the liquid is substantially completely led out from the liquid storage bag, a movement distance that the end of the second sealing joint portion has moved in the second direction from the reference position is $S1$. That is, when the second sealing joint portion is moved forward, the second sealing joint portion collides with the case as long as the case is not enlarged by the distance ($S1$-$S0$). Accordingly, the inequality cannot be satisfied. When the guide portion guides the second sealing joint portion in a direction other than the straight forward direction, the inequality is satisfied. Accordingly, it is not necessary to enlarge the case.

In the liquid storage container having the above-described configuration, a relation of $L0<L2<L1$ may be satisfied, assuming that in a state in which the liquid is not led out from the liquid storage bag, a distance between a support position of the liquid lead-out member of the liquid storage bag and a rear end of the second sealing joint portion of the liquid storage bag is $L0$; in a state in which the liquid is substantially led out from the liquid storage bag, a distance between the support position and the rear end of the second sealing joint portion of the liquid storage bag is $L1$; and a distance between the support position and an inner wall surface of the case facing the rear end of the second sealing joint portion is $L2$. In this case, when the second sealing joint portion is moved forward, the second sealing joint portion also collides with the case as long as the case is not enlarged by the distance ($S1$-$S0$). Accordingly, the inequality cannot be satisfied. When the guide portion guides the second sealing joint portion in a direction other than the straight forward direction, the inequality is satisfied. Accordingly, it is not necessary to enlarge the case.

In the liquid storage container having the above-described configuration, the flexible member may include first to third flexible member. In addition, the second sealing joint portion may be formed by joining the first to third flexible members in such a manner that the third flexible member bent in a bending line is disposed between the first and second flexible members, the first to third flexible members are joined together in a sealing manner on the bending line of the third flexible member, whereby the opposing surfaces of the first and third flexible members are joined together in a sealing manner and the opposing surfaces of the second and third flexible members are joined together in a sealing manner. That is because the side edges are not sealed, and thus the displacement in the longitudinal direction is large.

In the liquid storage container having the above-described configuration, both corners of the second edge may be cut in areas in which the opposing surfaces of the first and third flexible members are joined together in a sealing manner and the opposing surfaces of the second and third flexible members are joined together in a sealing manner. In addition, the length of the second edge may be shorter than that of the first edge. With such a configuration, friction resistance of the movement edge is small, thereby smoothly moving the movement edge.

The reception portion may be formed in various manners. First, the case may include a bottom wall, a peripheral wall, and an opening. The bottom wall and the peripheral wall may form a concave portion for holding the liquid storage bag and the liquid lead-out member. In addition, the liquid storage bag may have a thickness varying area of which the thickness varies from the second sealing joint portion to the center thereof.

The liquid storage bag may be a spacer member which is disposed closer to the opening of the case than the second sealing joint portion and the thickness varying area and supported by the case. The spacer member may include an opposing surface opposite the peripheral wall. In addition, the reception portion may include a dead space between the peripheral wall and the opposing surface of the spacer member.

In the liquid storage container having the above-described configuration, the case may include a spacer protrusion protruding from the bottom wall toward the second sealing joint portion and the thickness varying area. The spacer protrusion may include an opposing surface opposite the peripheral wall. In this case, the reception portion may include a dead space between the peripheral wall and the opposing surface of the spacer protrusion.

Moreover, the spacer member may be also disposed in the bottom wall of the case closer than the second sealing joint portion and the thickness varying area.

In the liquid storage container having the above-described configuration, the reception portion may be formed using the dead space formed in the case.

In the liquid storage container having the above-described configuration, the spacer member may be further provided with a spacer protrusion protruding from the bottom wall of the case toward the second sealing joint portion and the thickness varying area. In this case, the spacer protrusion includes the guide portion, and the guide portion can guide the second sealing joint portion to the reception portion.

In the liquid storage container having the above-described configuration, the spacer member may be further provided with the spacer member which is disposed in the opening of the case closer than the second sealing joint portion and the thickness varying area and is supported by the case. In this case, the spacer member can include the guide portion, and the guide portion can guide the second sealing joint portion to the reception portion.

The liquid storage container having the above-described configuration may include a first spacer member which is disposed in the opening of the case closer than the second sealing joint portion and the thickness varying area and supported by the case and a second spacer member which is disposed in the opening of the case closer than the second sealing joint portion and the thickness varying area and supported by the case. The reception portion may include a dead space between the peripheral wall and the opposing surface of the first spacer member. In addition, the second spacer member may include the guide portion, and the guide portion can guide the second sealing joint portion to the reception portion. Conversely, the reception portion may include a dead space between the peripheral wall and the opposing surface of the first spacer member. In addition, the first spacer member may include the guide portion, and the guide portion can guide the second sealing joint portion to the reception portion.

The liquid storage container having the above-described configuration may further include a sealing film which is formed in the pressurizing chamber capable of introducing a pressurizing liquid into the case. In addition, the invention is not limited to the case in which the liquid is provided by the pressurizing, but may be applied to a case in which the liquid is provided by sucking.

The liquid storage container having the above-described configuration may further include a liquid level detecting unit which is connected to the liquid lead-out member. The liquid level detecting unit may include a connection needle inserted into the liquid lead-out member and a liquid discharging member for discharging a liquid led out from the connection needle. In addition, the liquid level detecting unit may detect an amount of remaining liquid between the connection needle and the liquid discharging member.

According to another aspect of the invention, there is provided a method of refilling a liquid into the liquid storage bag of the liquid storage container according to the liquid storage container through the liquid lead-out member after the liquid storage bag is led out. The method includes: inserting a liquid injecting needle into the liquid lead-out member and operating a valve mechanism mounted in the liquid lead-out member to refill the liquid into the liquid storage bag; refilling the liquid into the liquid storage bag through the liquid injecting needle; and displacing the second sealing joint portion received in the reception portion in accordance with expansion of the liquid storage bag before starting the refilling to return the second sealing joint portion to the inside of the case closer than the reception portion.

In the method described above, the second sealing joint portion which has been received in the reception portion is returned to the inside of the case closer than the reception portion after the refilling. Accordingly, the second sealing joint portion can be freely displaced even when the liquid storage container is re-used.

In this case, the second sealing joint portion which has been received in the reception portion before start of the refilling can be returned to the inside of the case closer than the reception portion by displacing the second sealing joint portion along the guide portion when the liquid storage bag is expanded. In this way, it is possible to smoothly return the second sealing joint portion to the original position in the refilling.

The above-described refilling method can be applied to a case in which the liquid storage bag is refilled with a liquid through the liquid level detecting unit and the liquid lead-out member. In this case, the liquid storage bag is configured so as to be refilled with the liquid by inserting a liquid injecting needle into the liquid discharging member of the liquid level detecting unit and operating a valve mechanism mounted in the liquid discharging member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail. The invention described in Claims is not limited by the following description, and the entire configuration described in the embodiment is not necessarily indispensable as a solution.

Liquid Consuming Apparatus

Figure 1:
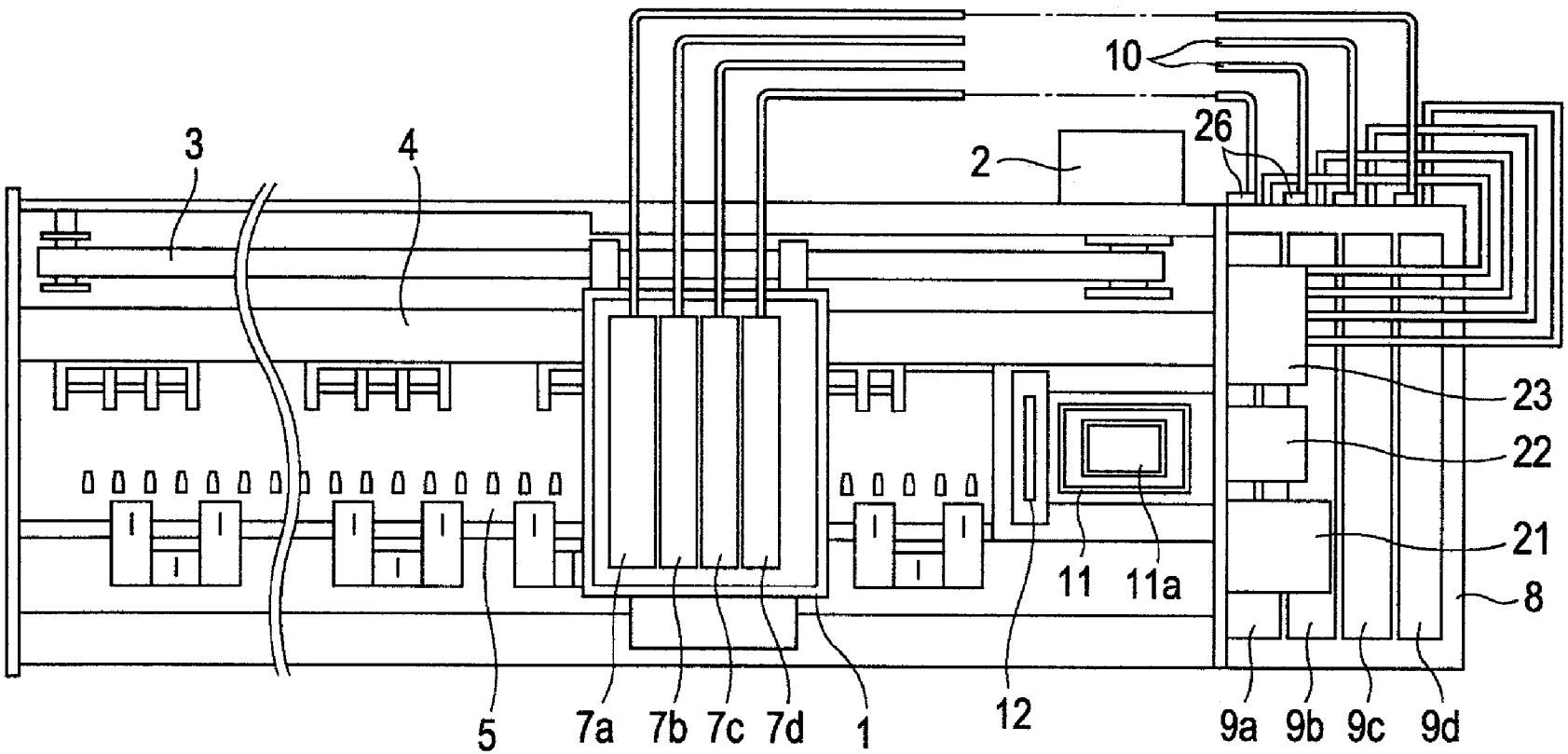
FIG. 1 is a top view illustrating an ink jet printing apparatus as one example of a liquid consuming apparatus including a liquid storage container according to the invention.

In this embodiment, a liquid consuming apparatus such as a printing apparatus using an ink cartridge as an example of a liquid storage container will be described with reference to the drawings. FIG. 1 is a top view illustrating an overall configuration of the printing apparatus. A carriage 1 shown in FIG. 1 is moved through a timing belt 3 driven by a carriage motor 2. The carriage 1 is guided to a scanning guide member 4 to reciprocate in a longitudinal direction of a sheet-feeding member 5, that is, a main scanning direction which is a thickness direction of a printing sheet. In addition, although not shown in FIG. 1, an ink jet printing head 6 is mounted on a surface opposite the sheet-feeding member 5 of the carriage 1.

Sub-tanks 7*a* to 7*d* for supplying ink to the printing head is mounted in the carriage 1. In this embodiment, the four sub-tanks 7*a* to 7*d* for temporarily storing each ink therein are provided so as to correspond to each ink. In addition, each ink of black, yellow, magenta, and cyan is supplied to each of the sub-tanks 7*a* to 7*d*. Each ink is supplied from main tanks 9*a* to 9*d* as ink cartridges mounted in the cartridge holder 8 of an apparatus body through flexible ink supply tubes 10.

As described in detail below, each of the main tanks 9*a* to 9*d* as the ink cartridges has a flat exterior surface which is erectly mounted in a cartridge holder 8 in a vertical direction.

A capping unit 11 for sealing a nozzle forming surface of the printing head is disposed in a non-print area (a home position) of the movement path of the carriage 1. In addition, a cap member 11*a* which is a flexible member made of rubber capable of sealing the nozzle forming surface of the printing head is disposed on the upper surface of the capping unit 11. When the carriage 1 is moved to the home position, the nozzle forming surface of the printing head is configured so as to be sealed by the cap member 11*a*.

The cap member 11*a* seals the nozzle forming surface of the printing head during stop of the printing apparatus, that is, serves as a cover body for preventing nozzle openings from being dry. Although not shown in the figure, one end of a tube of a suction pump (a tube pump) is connected to the cap member 11*a*. A negative pressure generated by the suction pump is applied to the printing head to perform cleaning of sucking each ink from the printing head and discharging the ink. In addition, a wiping member 12 made of an elastic material such as rubber is disposed so as to be adjacent to a printing area of the capping member 11. Accordingly, it is possible to clean the nozzle forming surface of the printing head, if necessary.

Figure 2:
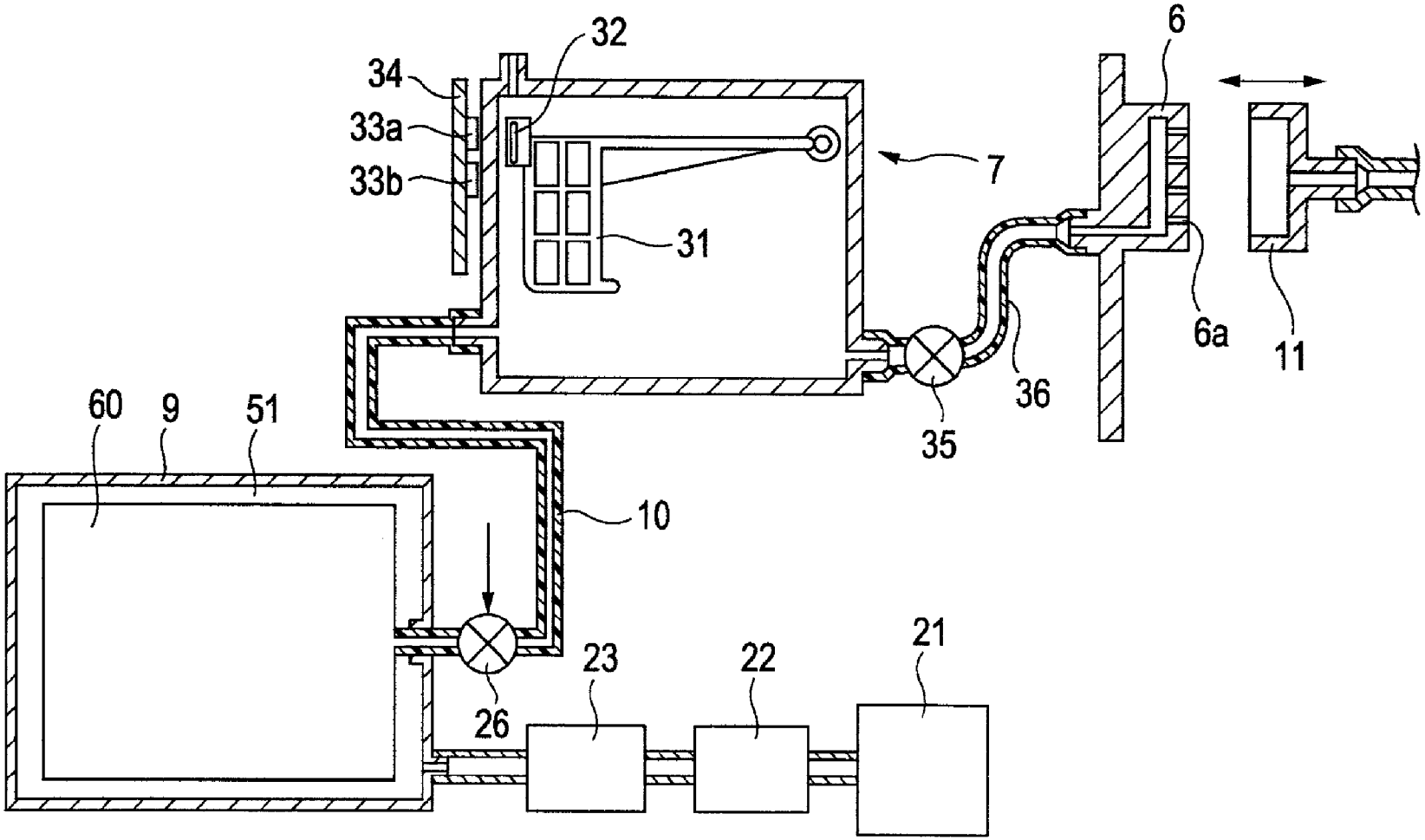
FIG. 2 is a schematic diagram illustrating an ink supply system from an ink cartridge to a printing head of the ink jet printing apparatus in FIG. 1.

FIG. 2 is a schematic diagram illustrating a configuration of an ink supply system mounted in the printing apparatus in FIG. 1. The ink supply system in which the same reference numerals are given to the corresponding elements will be described with reference to FIGS. 1 and 2. In FIGS. 1 and 2, air pressurized by an air pressurizing pump 21 is supplied to a pressure adjusting valve 22. The pressurizing air is supplied to each of the main tanks 9*a* to 9*d* (which are indicated by Reference Numeral 9 in FIG. 2) through a pressure detector 23. The pressure adjusting valve 22 opens a pressure and maintains the air pressure applied to the main tanks 9*a* to 9*d* in a predetermined range when the air pressure pressurized by the air pressurizing pump 21 reaches a predetermined pressure or more.

The pressure detector 23 detects the air pressure pressurized by the air pressurizing pump 21 to control drive of the air pressurizing pump 21. That is, when the air pressure pressurized by the air pressurizing pump 21 reaches the predetermined pressure, the drive of the air pressurizing pump 21 is stopped. Alternatively, when the pressure detector 23 detects that the air pressure reaches the predetermined pressure or less, the air pressurizing pump 21 is controlled so as to be driven. In this way, the air pressure applied to the main tanks 9*a* to 9*d* is maintained within the predetermined range by performing the above-described process.

As shown in FIG. 2, a case forming the exterior surface of each of the ink cartridges is air-tightly sealed. The detailed configuration of the ink cartridges as the main tanks 9 will be described below. An ink pack 60 which is a flexible member capable of sealing ink is received in each of the main tanks 9. A pressurizing chamber 51 is formed by each of the main tanks 9 and the ink pack 60. The pressurizing air is supplied to the pressurizing chamber 51 through the pressure detector 23. With such a configuration, the ink pack 60 received in the main tanks 9*a* to 9*d* is pressurized by the pressurizing air, and thus an ink stream is generated from the main tanks 9*a* to 9*d* to the sub-tanks 7*a* to 7*d* by a predetermined pressure.

The ink pressurized in the main tanks 9*a* to 9*d* is supplied to the sub-tanks 7*a* to 7*d* (which are indicated by Reference Numeral 7 in FIG. 2) mounted in the carriage 1. During the supply of the ink, the main tanks 9*a* to 9*d* are connected to ink supply valves 26 and the ink supply tubes 10.

As shown in FIG. 2, a float member 31 is disposed inside the sub-tanks 7 and a permanent magnet 32 is attached to a part of the float member 31. Magnet conversion elements 33*a* and 33*b* as a hall element are mounted on a board 34 so as to be attached to a sidewall of the sub-tanks 7. With such a configuration, there is provided an ink level detecting unit in which the permanent magnet 32 attached to the float member 31 and the magnet conversion elements 33*a* and 33*b* generate an electrical output according to a magnetic force of the permanent magnet 32 on the basis of floating position of the float member 31. If an ink level detecting unit is provided in the main tanks 9, the sub-tanks 7 may be omitted.

The ink is supplied from the sub-tanks 7 or the main tanks 9 to the printing head 6 through valves 35 and tubes 36. On the basis of printing data supplied to the printing head 6, ink drops are ejected from nozzle openings 6*a* formed on the nozzle forming surface of the printing head 6. In addition, a tube connected to the capping unit 11 shown in FIG. 2 is connected to the suction pump (the tube pump) (not shown).

Overview of Ink Cartridge

Figure 3:
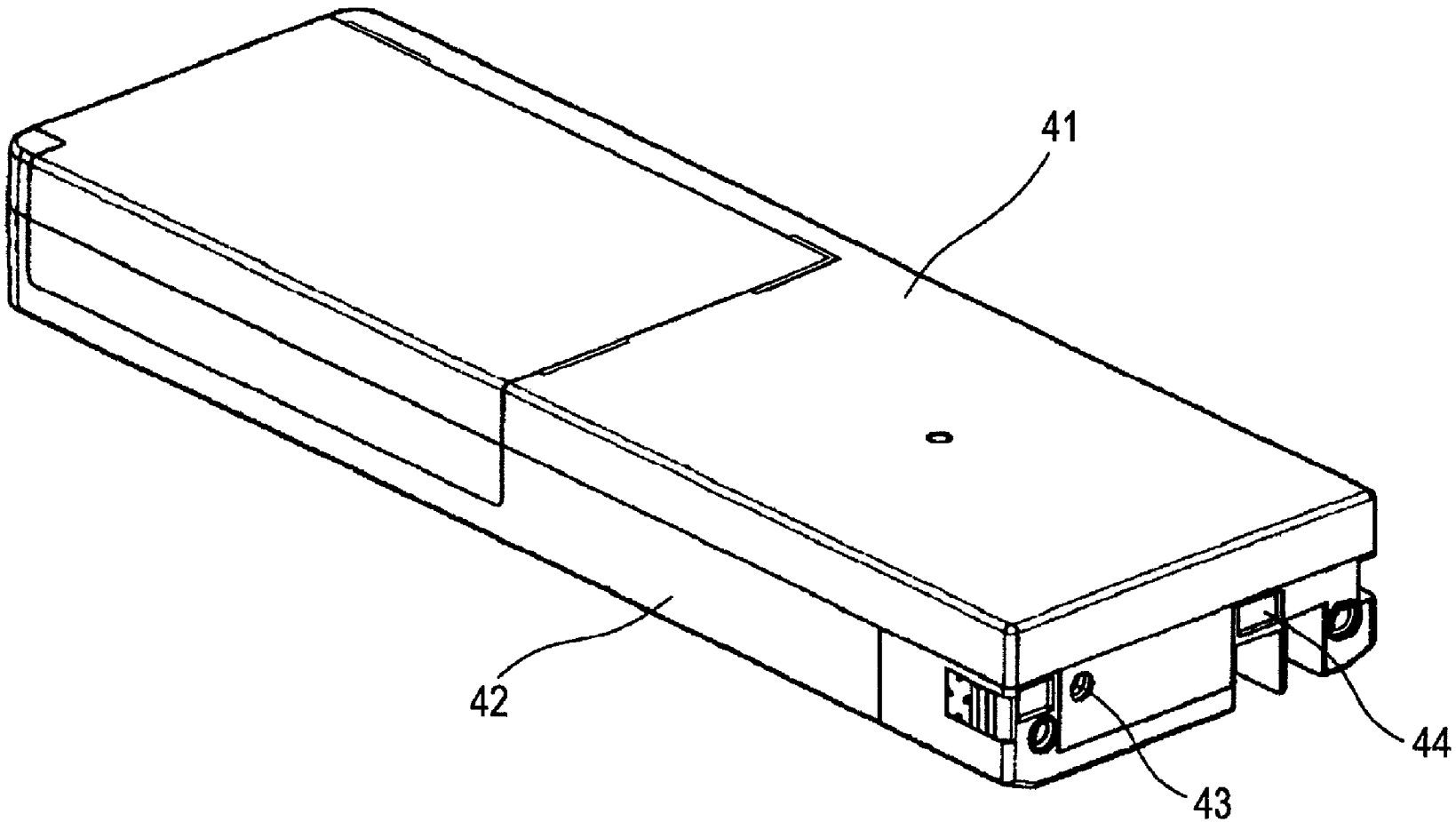
FIG. 3 is a perspective view illustrating an overall ink cartridge as one example of the liquid storage container according to the invention.

FIG. 3 is a perspective view illustrating an overview of the main tanks 9 for containing a liquid according to the invention. Each of the main tanks 9 has an upper case 41 as a cover body and a lower case 42 as a chassis. On the front surface of each of the main tanks 9, an ink lead-out port 43 disposed on the upper case 41 and a pressurizing air lead-in port 44 disposed on the lower case 42, for example, are provided.

Figure 4:
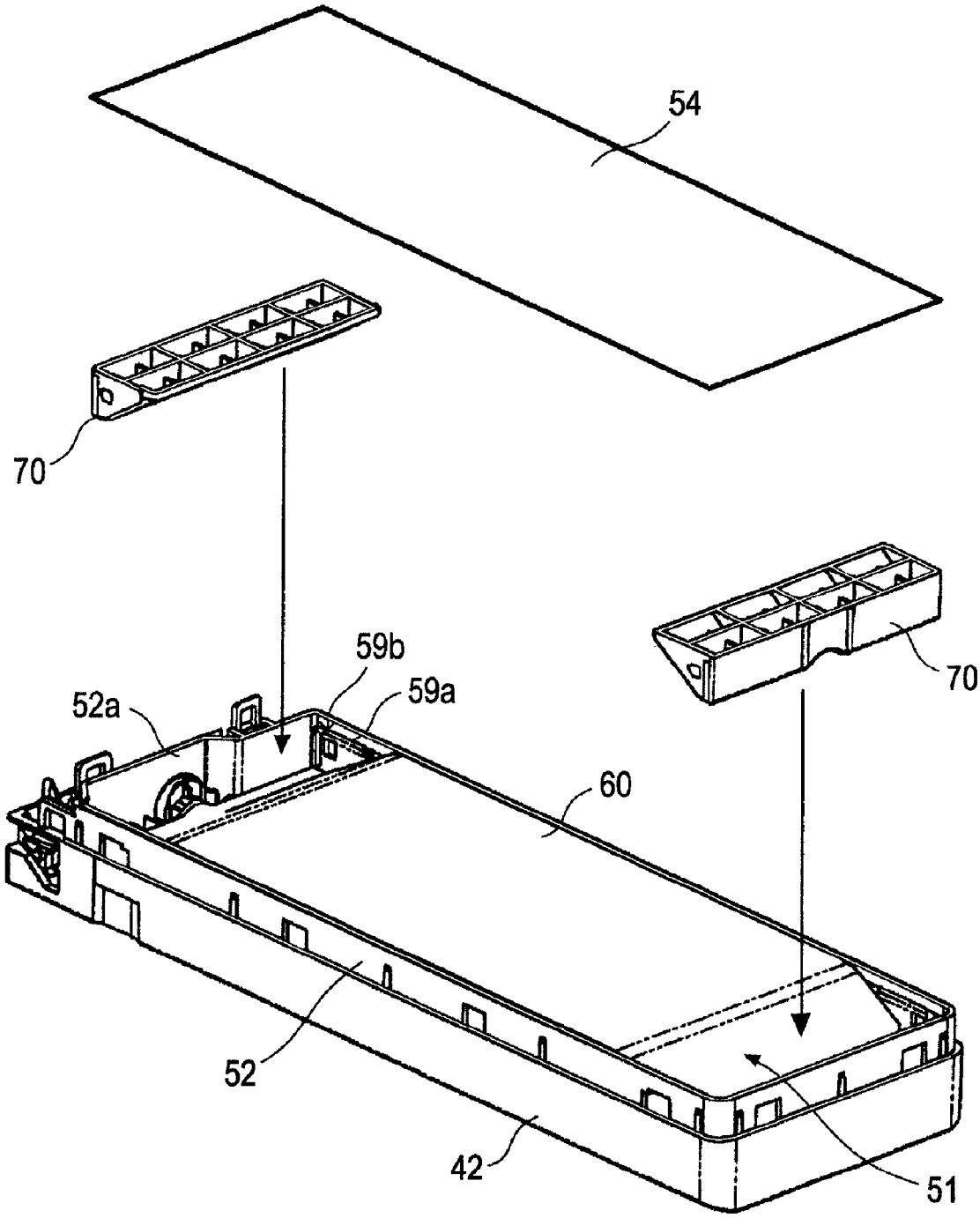
FIG. 4 is an exploded perspective view illustrating the ink cartridge in FIG. 3.
Figure 5:
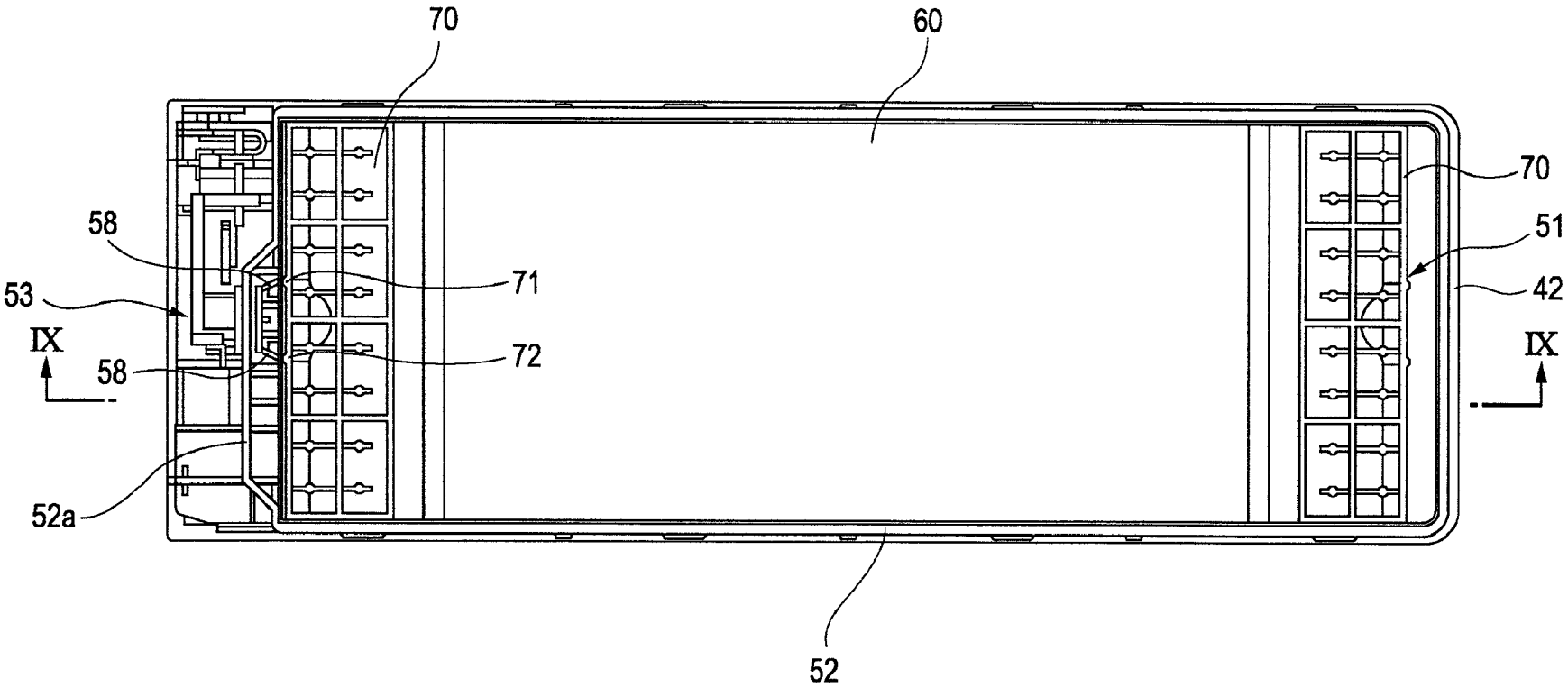
FIG. 5 is a top view illustrating the assembled ink cartridge excluding an upper case and a sealing film.

FIG. 4 is an exploded perspective view illustrating the main tanks 9 excluding the upper case 41. FIG. 5 is a top view illustrating the main tanks 9 excluding the upper case 41 and a sealing film 70. Inside the lower case 42, the ink pack 60 as a liquid storage bag is received in a concave portion 51 surrounded by a peripheral wall 52. The front surface of the peripheral wall 52 is a partition wall 52*a* and an ink level detecting unit 53 shown in FIG. 5 is disposed outside the partition wall 52*a*. In addition, spacer members 70 are each disposed in a front upper space and a rear upper space of the ink pack 60. Afterward, an open surface of the lower case 42 is sealed by a sealing film 54, so that the concave portion 51 is air-tightly sealed as a pressurizing chamber.

Figure 6:
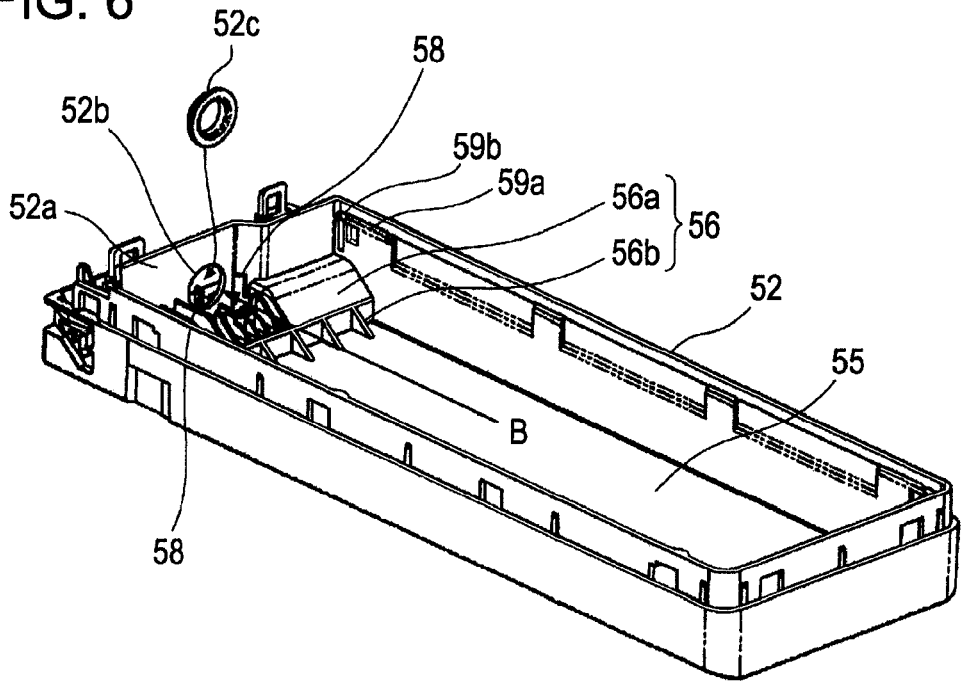
FIG. 6 is a schematic perspective view illustrating the sealing member disposed in a lower case.

Next, a method of adhering the ink pack 60 and the spacer members 70 to the lower case 42 will be described. As shown in FIG. 6, a sealing member 52*c* which is a sectional ring-shaped elastic body is disposed in a hole 52*b* formed through the partition wall 52*a* before the ink pack 60 is adhered. The sealing member 52*c* formed of, for example, a rubber packing air-tightly seals the hole 52*b* and prevents air from leaking from the concave portion (the pressurizing chamber) 51 sealed by the sealing film 54.

Figure 7:
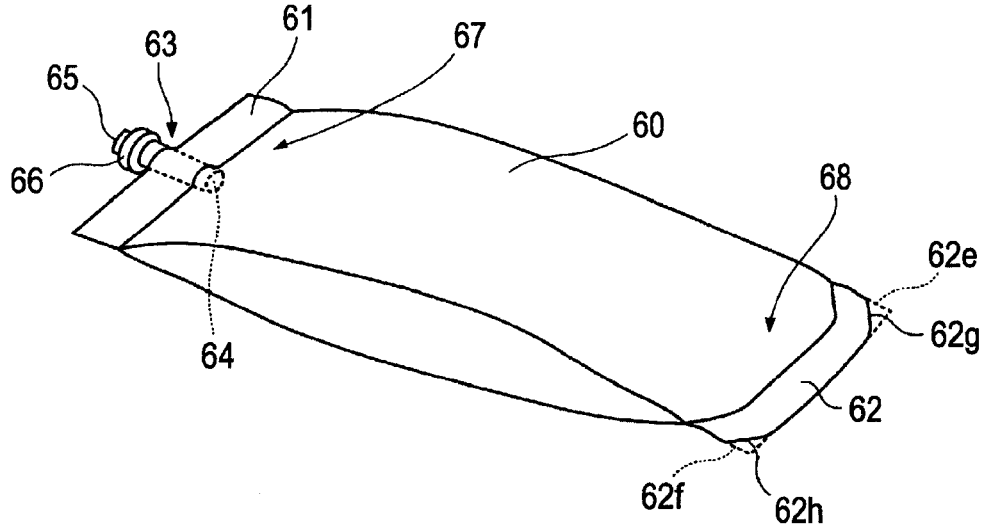
FIG. 7 is a schematic perspective view illustrating an ink pack as a liquid containing bag body.

In this embodiment, a gusset type ink pack 60 is mainly used in a large-capacity container. As shown in FIG. 7, the ink pack 60 is provided with a first sealing joint portion 61 which is formed in a first edge of the front portion of the ink pack 60 and a second sealing joint portion 62 which is formed in a second edge of the rear portion opposite the first edge. The ink lead-out member 63 is inserted into the first sealing joint portion 61.

Figure 22A:
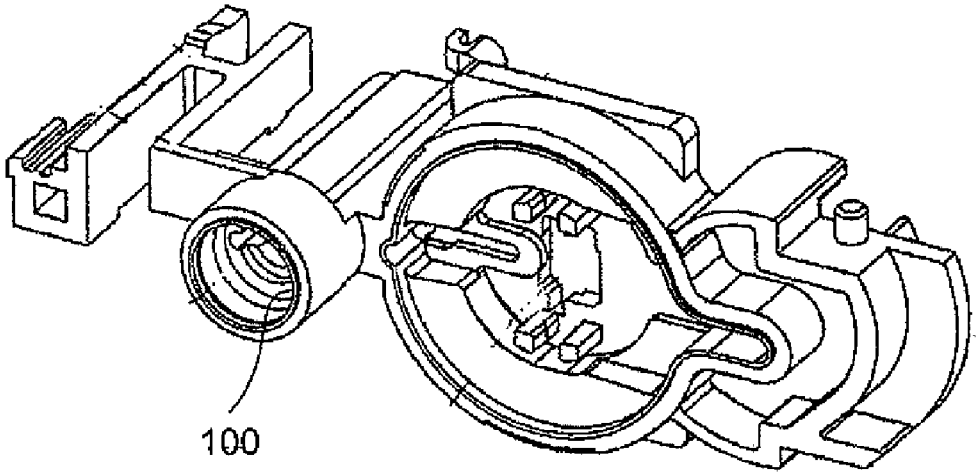
FIGS. 22A and 22B are exemplary views of an ink level detecting unit.
Figure 22B:
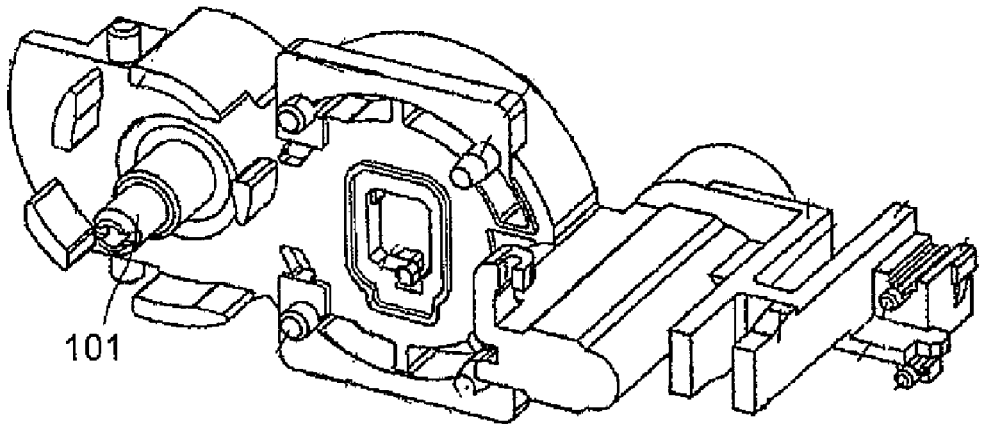

A base end 64 of the ink lead-out member 63 is connected to the ink pack 60 through the first sealing joint portion 61. A flange portion 66 is formed in a lead-out end 65 of the front end portion. The ink lead-out member 63 has a valve mechanism therein. When the ink level detecting unit 53 (see FIG. 5) is set from the outside of the partition wall 52*a*, a connection needle 101 (see FIG. 22B) provided in the ink level detecting unit 53 is inserted into the ink lead-out member 63. The connection needle operates the valve mechanism inside the ink lead-out member 63 and leads out the ink contained in the ink pack 60. The ink level detecting unit 53 includes the connection needle inserted into the ink lead-out member 63 of the ink pack 60 and an ink discharging member 100 (see FIG. 22A) for discharging ink led out from the connection needle. In addition, the ink level detecting unit 53 detects an amount of remaining ink between the connection needle and the ink discharging member. In addition, the ink discharging member included in the ink level detecting unit 53 can discharge the ink on the substantially same principle as that of the ink lead-out member 63.

The ink pack 60 is formed of two rectangular sheets (the first sealing joint portion) of a flexible member or three rectangular sheets (the second sealing joint portion) of a flexible member. Moreover, aluminum or the like is laminated on the surface of the ink pack 60 in order to improve a gas barrier property.

The ink pack 60 is formed in an envelope shape as follows. That is, the first edge is sealed by, for example, thermal welding with the ink lead-out member 63 inserted into the first edge, and the first sealing joint portion 61 is formed. Subsequently, ink is contained from the second edge in an open state. Finally, the second edge is adhered by, for example, thermal welding, and the second sealing joint portion 62 is formed to complete the ink pack 60.

Figure 8:
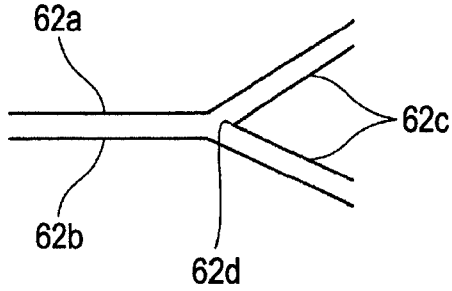
FIG. 8 is a schematic sectional view illustrating a sectional surface of a second sealing joint portion in FIG. 7.

FIG. 8 is a schematic sectional view illustrating a sectional surface of the second sealing joint portion 62 in FIG. 7. The second sealing joint portion 62 includes three flexible members of a first flexible member 62*a*, a second flexible member 62*b*, and a third flexible member 62*c* bent in a bent line 62*d* between the first flexible member 62*a* and the second flexible member 62*b*. In addition, the first flexible member 62*a*, a second flexible member 62*b*, and the third flexible member 62*c* are adhered in the bent line 62*d*. The opposite surfaces of the first flexible member 62*a* and the third flexible member 62*c* are adhered and the opposite surfaces of the second flexible member 62*b* and the third flexible member 62*c* are adhered to form the second sealing joint portion 62. The adhesion of the bent line 62*d* in which the three flexible members 62*a* to 62*c* are met with each other is weak. However, a sealing property is sufficiently secured since the portion in which the adhesion is weak is inside the adhesion area in which the two flexible members having strong adhesion are adhered.

In this embodiment, cut portions 62*g* and 62*h* of both corners 62*e* and 62*f*, which are indicated by a dashed line in FIG. 7, are cut in the second sealing joint portion 62. In this way, burrs generated at the corners are removed and the corners 62*e* and 62*f* are chamfered. Therefore, as described below, it is possible to reduce movement resistance of the front end of the second sealing joint portion 62.

The liquid storage container according to this embodiment is not limited to the gusset type ink pack 60 in FIG. 7, but a pillow type ink pack of which four edges are adhered by two rectangular sheets of a flexible member may be used. In this case, a sealing joint portion is formed in the first edge of the first sealing joint portion connected to the ink lead-out member 63, and sealing joint portions are also formed in three edges of two edges perpendicular to the first edge and an edge opposite the first edge.

Figure 9:
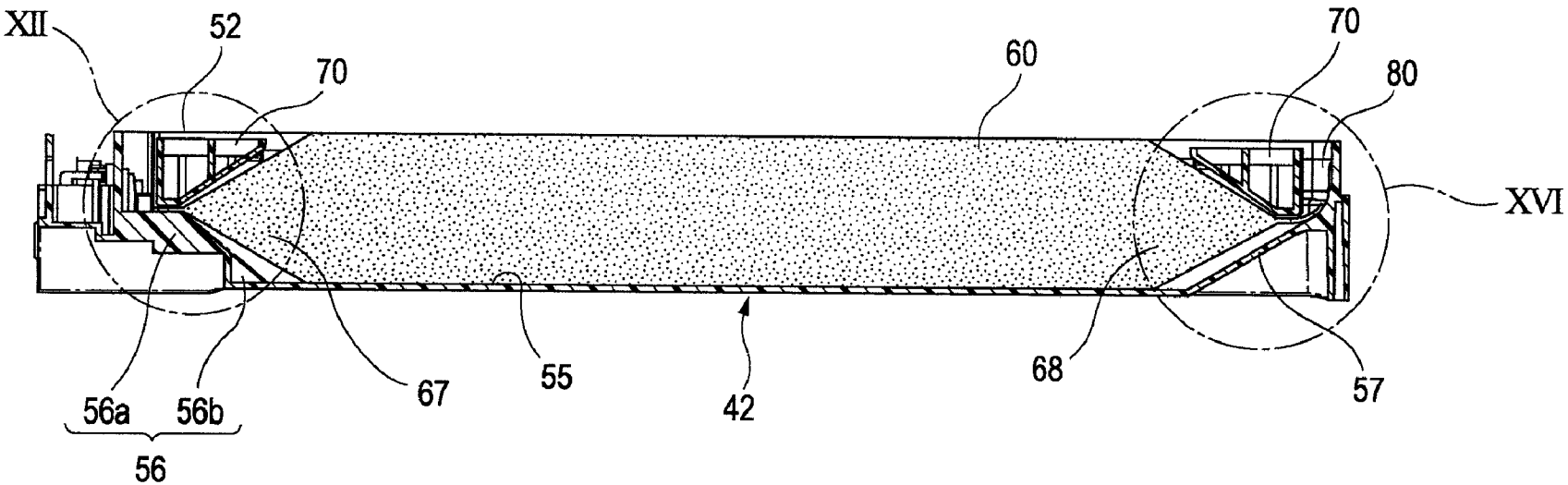
FIG. 9 is a sectional view illustrating the ink cartridge taken along IX-IX in FIG. 5.

As shown in FIG. 7 or FIG. 9, which is a sectional view taken along IX-IX in FIG. 5, the ink pack 60 filled with ink includes thickness varying areas 67 and 68 in which the thickness thereof varies from the first sealing joint portion 61 and the second sealing joint portion 62 to the center of the ink pack 60. That is, the thickness of the front edge and the rear edge of the ink pack 60 varies. Spaces are formed in the thickness varying areas 67 and 68 even though the upper case 41 is attached to the lower case 42 with the sealing film 54 for sealing the open surface of the lower case 42 interposed therebetween. If the spaces are neglected, the ink pack 60 may be damaged due to impact when transported, and a pressurized volume may become increased.

Figure 10:
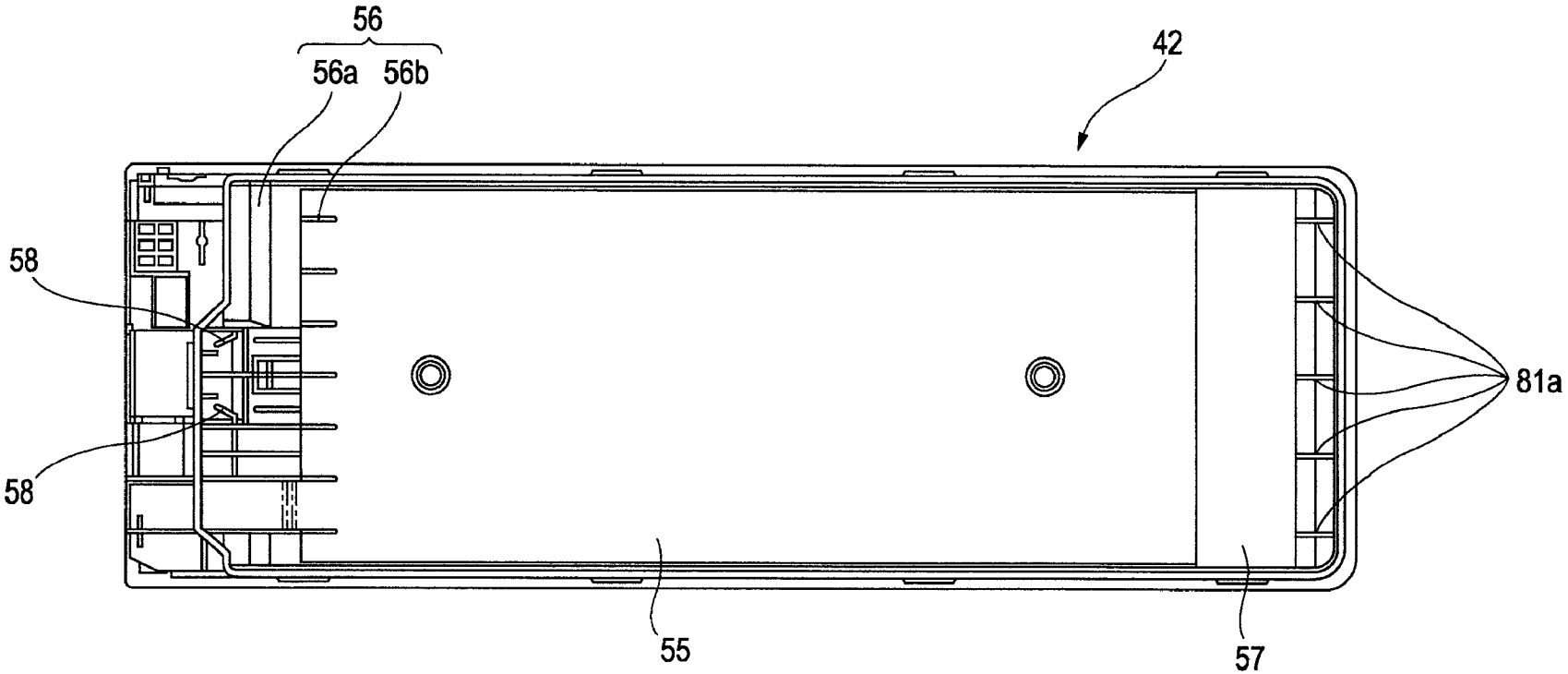
FIG. 10 is a top view illustrating the lower case.

As shown in FIGS. 6 and 9 and FIG. 10, which is a top view illustrating the lower case 42, spacer protrusions 56 and 57 which rise from a bottom surface 55 are disposed inside the peripheral wall 52 of the lower case 42. The spacer protrusion 56 in the front edge of the lower case 42 occupies the down portion of the thickness varying area 67 in the front edge of the ink pack 60. The spacer protrusion 56 includes a bulge 56*a* bulged from the bottom wall 55 and a rib 56*b*. The upper surfaces of the bulge 56*a* and the rib 56*b* are inclined at the same angle. On the other hand, the spacer protrusion 57 in the rear edge of the lower case 42 occupies the down portion of the thickness varying area 68 in the rear edge of the ink pack 60. The spacer protrusion 57 includes a bugle bulged from the bottom wall 55.

Method of Attaching Ink Pack Using Suppressing Member

A method of attaching the ink pack 60 to the lower case 42 with such a configuration will be described.

As shown in FIG. 6, the sealing member 52*c* with a sectional ring shape is disposed in the hole 52*b* formed through the partition wall 52*a* of the lower case 42. The ink pack 60 is inserted in a B direction shown in FIG. 6 from the inside of the lower case 42 so that the lead-out end 65 of the ink lead-out member 63 is fitted to the sealing member 52*c*.

As shown in FIGS. 6, 10, 11 and FIG. 12, which is an expanded view illustrating a XII portion in FIG. 9, fixing ribs 58 extending from the bottom wall 55 in an upward vertical direction in the lower case 42.

The fixing ribs 58 are formed so that the gap between the two fixing ribs 58 is narrowed in the downstream of the B direction (see FIG. 6). The two fixing ribs 58 are elastically deformed by the flange portion 66 and the gap therebetween is widened in a direction intersecting the B direction when the lead-out end 65 of the ink lead-out member 63 is moved in the B direction to be inserted into the sealing member 52*c*. In addition, when the ink lead-out member 63 reaches a position at which it is sealed by the sealing member 52*c*, the fixing ribs 58 are elastically restored to be opposed to the insertion rear end of the flange 65. That is, the two fixing ribs 58 are opposed to the insertion rear end of the flange 65 of the ink lead-out member 63, and serve as a stopper which prevents the ink lead-out member 63 from being detached.

A problem arises in that it is difficult for the two fixing ribs 58 to serve as the stopper capable of resisting impact. That is because the fixing ribs 58 become slim as they are elastically deformed. In particular, if a large capacity ink pack 60 according to this embodiment is used, an excessive load is applied to the two fixing ribs 58 in a case where the ink cartridge 9 falls.

Accordingly, in this embodiment, a suppressing member for suppressing the deformation of the two fixing ribs 58 in an E direction (see FIG. 12) which is a reverse direction of the B direction. The suppressing member may be incorporated with the lower case 42 by use of injection molding. That is because a rigid body can be disposed so as to slightly get away from the rear end of the fixing ribs 58. In order to incorporate the suppressing member protruding so as to slightly get away from the rear end of the fixing ribs 58 with the lower case 42, a groove is necessary between the fixing ribs 58 and the suppressing member. In addition, in order to form the groove, a protruding portion with a thin plate is reversely necessary in a molding tool. In a case where the protrusion portion cannot be realized by grinding of the molding tool, a thin plate for forming the protrusion portion is buried and fixed. However, the molding tool becomes complicated.

In order to solve such a problem, the suppressing member disposed so as to slightly get away from the rear end of the fixing ribs 58 is disposed as a separate member from the lower case 42 after the ink pack 60 is disposed. In addition, each of the spacer members 70 has a function of the suppressing member.

FIGS. 13A to 13F are a front view, a top view, a left side view, a rear view, a bottom view illustrating the spacer member 70, respectively. The spacer member 70 is formed as a rigid body by injection molding using, for example, a synthetic resin. However, a spacer member (pressing member) disclosed in JP-A-2002-19136 is formed of an elastic material such as foamed polystyrene.

As shown in FIGS. 13A to 13F, two suppressing ribs 72 which serves as the suppressing member protrude from a front surface 71 of the spacer member 70.

The spacer member 70 has the front surface 71, an upper surface 73, and a slope surface 74 connecting the front surface 71 to the upper surface 73. The transverse cross section of the spacer member 70 is substantially triangular. The upper surface 73 is made smooth so that the thickness thereof is uniform in the injection molding. As shown in FIG. 9, the slope surface 74 almost corresponds to slope surfaces of the thickness varying area 67 and 68 of the ink pack 60.

Figure 13A:
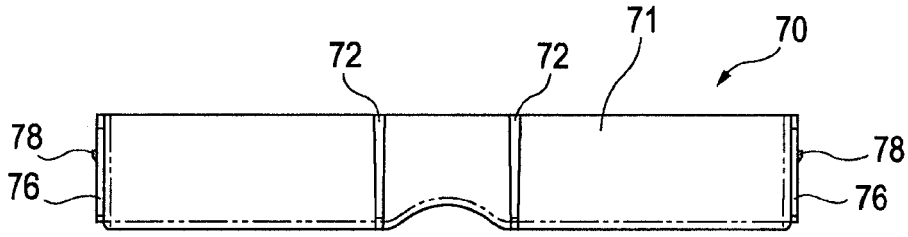
FIGS. 13A to 13F are a front view, a top view, a left side view, a rear view, a bottom view illustrating a spacer member, respectively.
Figures 13B, 13C, 13D:
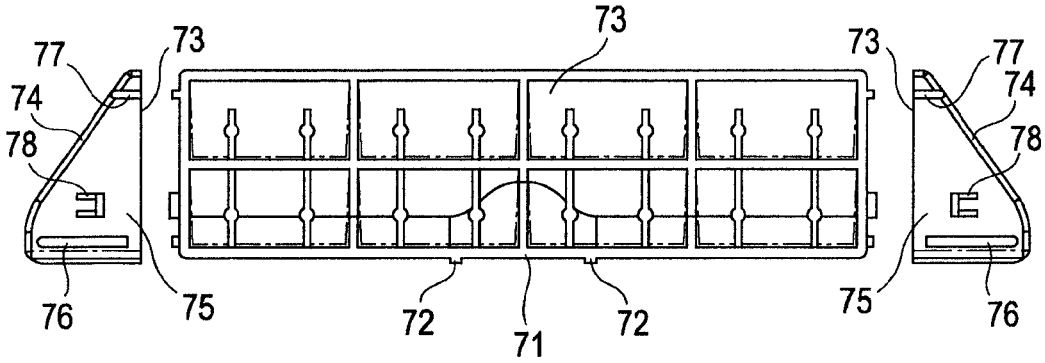
Figure 13E:
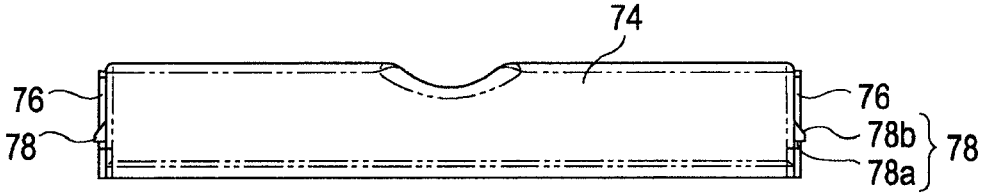
Figure 13F:
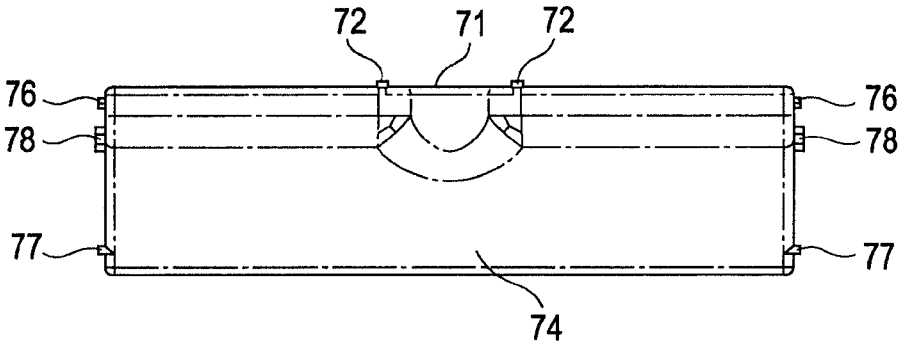

The spacer member 70 is positioned and fixed to the lower case 42. Accordingly, guide ribs 76 and 77 and locking portions 78 protrude from both side surfaces of the spacer member 70. As shown in FIG. 13E, each of the locking portions 78 includes a horizontal plane surface 78*a* and a slope surface 78*b* of which the thickness is gradually narrowed in a vertically downward direction of the horizontal plane surface 78*a*. On the other hand, as shown in FIGS. 4, 6, and 11, a locking portion 59*a* of which the protrusion height from the inner wall gradually increases in a vertically downward direction is disposed on the peripheral wall 52 of the lower case 42.

Figure 14:
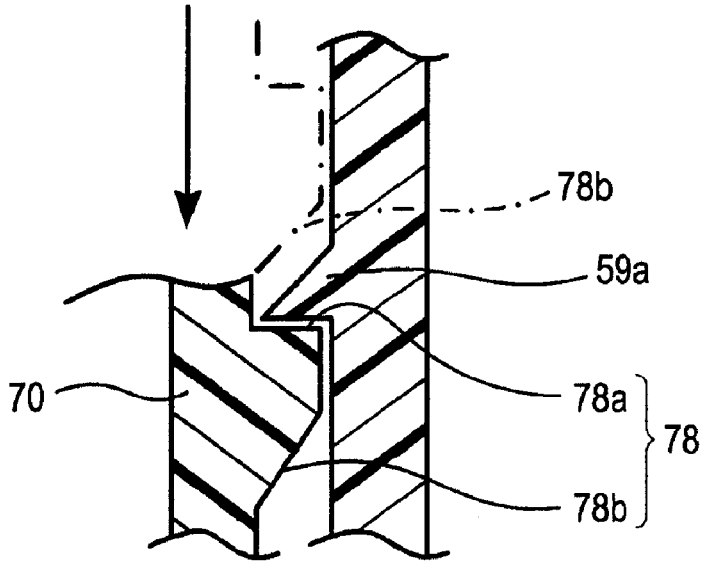
FIG. 14 is schematic sectional view illustrating the space member positioned in a vertical direction.

When the spacer member 70 is pressed in the vertically downward direction, that is, in an arrow direction, as shown in FIG. 14, the slope surface 78*b* comes in contact with the locking 59*a* and the locking 59*a* of the lower case 42 is elastically deformed. As shown by a solid line in FIG. 14, the locking portion 78 is then inserted into the lower portion of the locking portion 59*a*. The locking portion 59*a* serves as a stopper which prevents the locking portion 78 from being detached.

Figure 11:
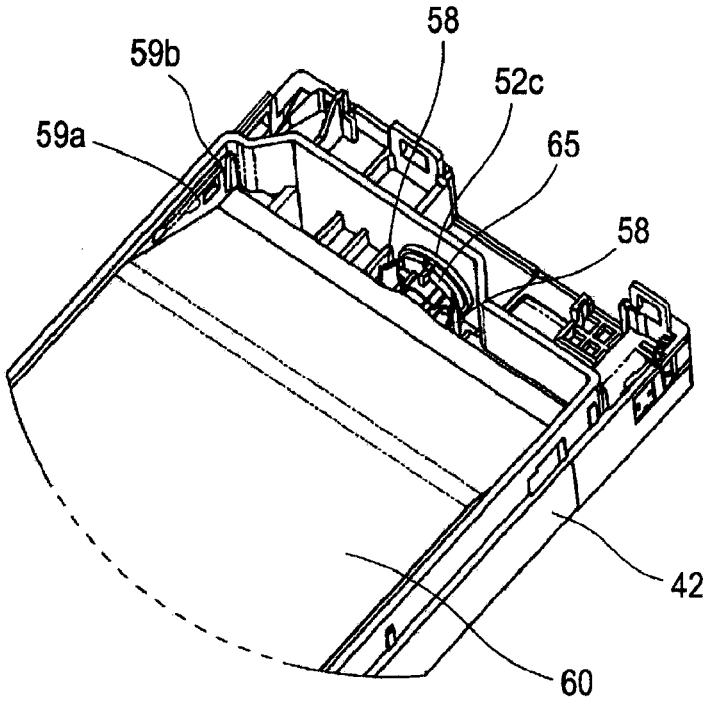
FIG. 11 is a partly perspective view illustrating the lower case attached with the sealing member and the ink pack.

On the peripheral wall 52 of the lower case 42, as shown in FIGS. 4, 6, and 11, a groove 59*b* is formed in one end of the peripheral wall 52 in a longitudinal direction of the locking portion 59*a*. The guide rib 76 of the spacer member 70 is guided along the groove 59*b*. The guide rib 77 comes in contact with the other end in the longitudinal direction of the locking portion 59*a* so as to be guided. The guide ribs 76 and 77 are guided so that the spacer member 70 is positioned in an anteroposterior direction by the locking portion 59*a* and the groove 59*b*.

Figure 12:
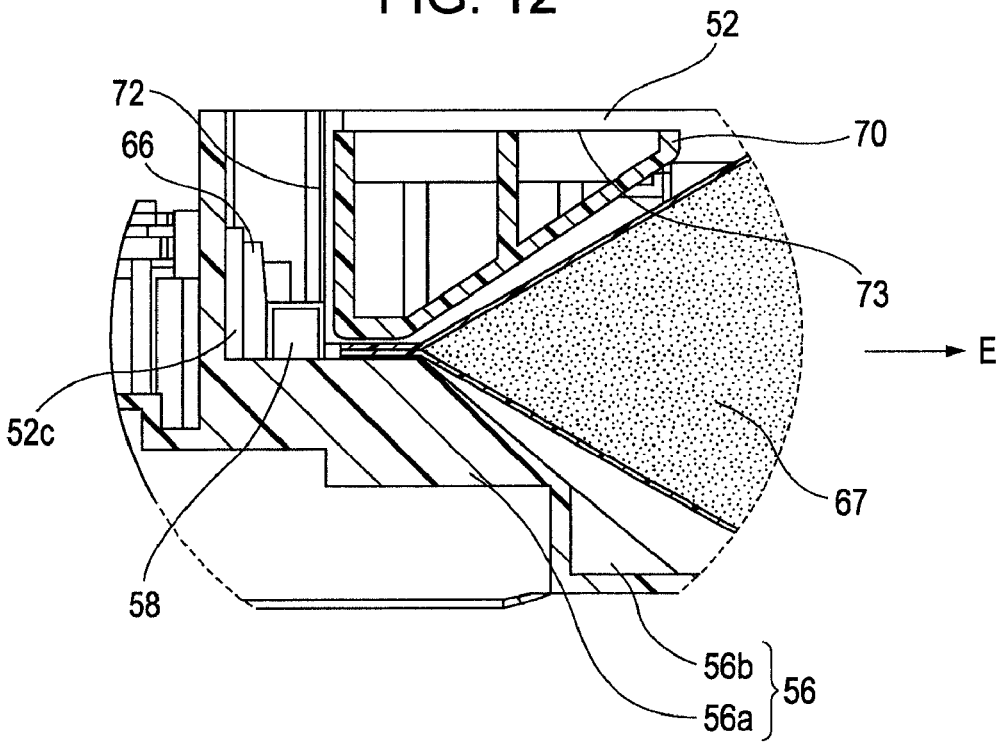
FIG. 12 is an expanded view illustrating a XII portion in FIG. 9.

In this way, the spacer member 70 is a rigid body which is positioned in the lower case 42 at least in the E direction (see FIG. 12). As shown in FIG. 12, the suppressing ribs 72 formed on the front surface 71 of the spacer member 70 are each a suppressing member which comes in contact with the rear ends of the fixing ribs 58 or slightly gets away from the rear ends thereof.

The ink pack 60 and the spacer members 70 received in the lower case 42 are provided, and an ink capacity sealed in the ink pack 60 is adjusted by the volume of the spacer members 70. Accordingly, various types of spacer members 70 may be provided, and the appropriate spacer member 70 can be selected depending on the ink capacity sealed in the ink pack 60 received in the lower case 42. Therefore, the ink pack 60 can be received in the lower case 42 without a large gap. Moreover, it is possible to prevent the ink pack 60 from being damaged due to the impact when it is transported.

When the pressurizing air is introduced into the pressurizing chamber 51 of the lower case 42, the spacer members 70 are received, thereby reducing the pressurizing air introduced into the pressurizing chamber 51. Accordingly, for example, it is possible to avoid delay at time when a standby state becomes after the application of a power source to the printing apparatus, thereby improving throughput.

In this way, the spacer members 70 are designed to be appropriate for the capacity of the ink pack 60. Accordingly, the spacer members 70 is filled with the empty space inside the pressurizing chamber 51 and press the ink pack 60 to prevent movement of the ink pack 60. Moreover, the spacer members 70 also serve as the suppressing member.

As shown in FIGS. 9 and 12, the upper surface 73 of the spacer members 70 fixed to the lower case 42 are positioned below the upper end of the peripheral wall 52 of the lower case 42. In other words, the spacer members 70 do not come in contact with the sealing film (see FIG. 4) 54 for covering the upper end opening of the peripheral wall 52. The spacer members 70 are completely positioned. Accordingly, the sealing film 54 is not torn by the spacer members 70 as the rigid body even though the spacer members 70 are slightly moved due to impact or the like. In the past, a spacer member made of an elastic material such as foamed polystyrene is thermally welded to the sealing film 54, but there is a high probability that the sealing film 54 is torn. In order to solve such a problem, the spacer members 70 are configured so as not to come in contact with the sealing film 54 since the spacer members 70 are the rigid body.

Absorption of Displacement of Second Sealing Joint Portion Using Reception Portion The spacer members 70 shown in FIGS. 13A to 13F are members disposed in the front edge and the rear edge of the lower case 42 shown in FIG. 9. The spacer member 70 disposed on the rear edge is also positioned in the lower case 42 in the same manner, but the function of the suppressing member is not necessary.

The spacer member 70 positioned in the rear edge forms a reception portion 80 (see FIG. 16 described below) for receiving the second sealing joint portion 62, which is displaced when the ink is led out from the ink pack 60, between opposite surfaces on which the spacer member 70 and the peripheral wall 52 are opposed to each other.

Figure 15:
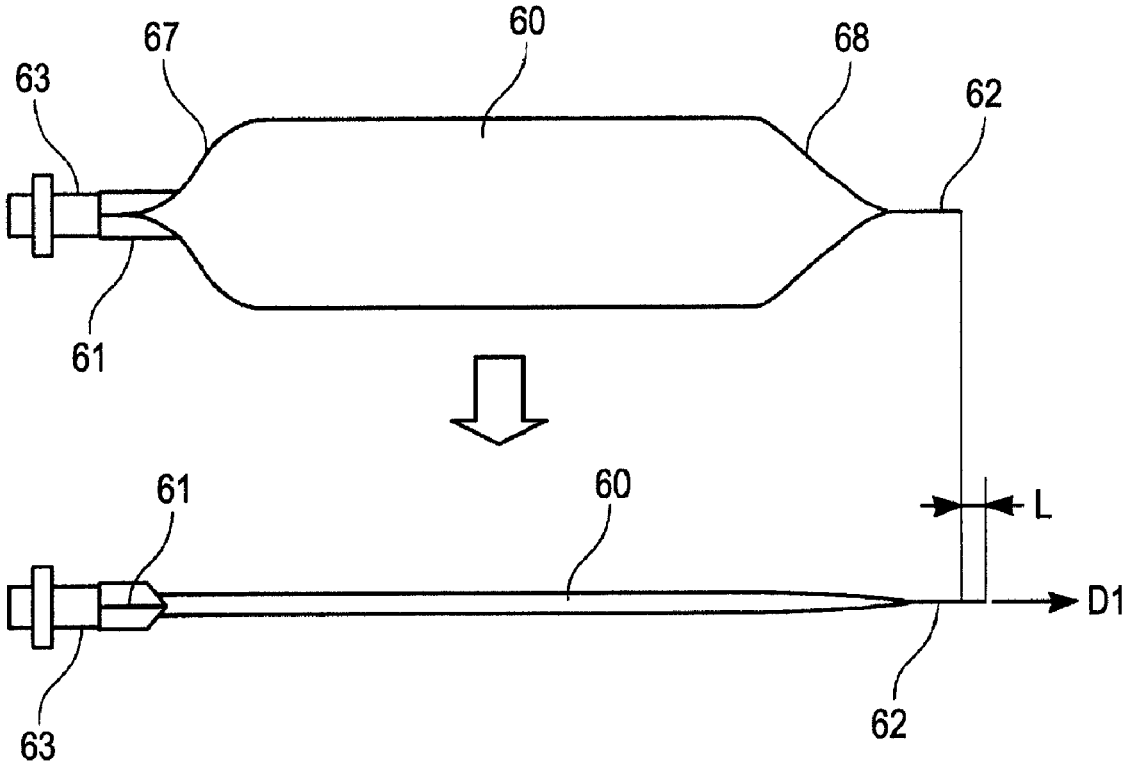
FIG. 15 is schematic view for explaining a second seal locking portion which is displaced depending on a change from a state in which the ink pack is filled to a state in which the ink pack becomes empty.

As schematically shown in FIG. 15, the state before the ink pack 60 is led out is different from the state after the ink pack 60 is not led out. In particular, the length in the longitudinal direction of the ink pack 60 which is in the state the ink is led out is longer by L, as shown in FIG. 15. In this case, the ink lead-out member 63 is supported by the lower case 42. Accordingly, in a state in which the reception portion 80 is not present, the second sealing joint portion 62 of the ink pack 60 in the empty state in which the ink is led out becomes displaced by L in a first direction D1. The above-described reception portion 80 receives the displacement L of the second sealing joint portion 62.

A known technique does not have any solution. In particular, such a solution is not necessary in the above-described pillow type ink pack which contains a small amount of ink and of which four edges are sealed since the displacement of a sealed portion is considerably small. In fact, in FIG. 4 in JP-A-2002-19136, for example, a sectional view illustrating a first sealing joint portion for sealing an ink lead-out portion and sealing joint portions of two edges perpendicular the first adhesion is disclosed. However, a considerably small gap is formed between the front end of the two sealing joint portion and a case. In the same figure, a considerably small gap is also formed between a spacer member and an inner wall of the case. However, the sealing joint portion cannot be inserted into the considerably small gap. Moreover, it is considered that the gap is not designed in this manner.

Figure 16:
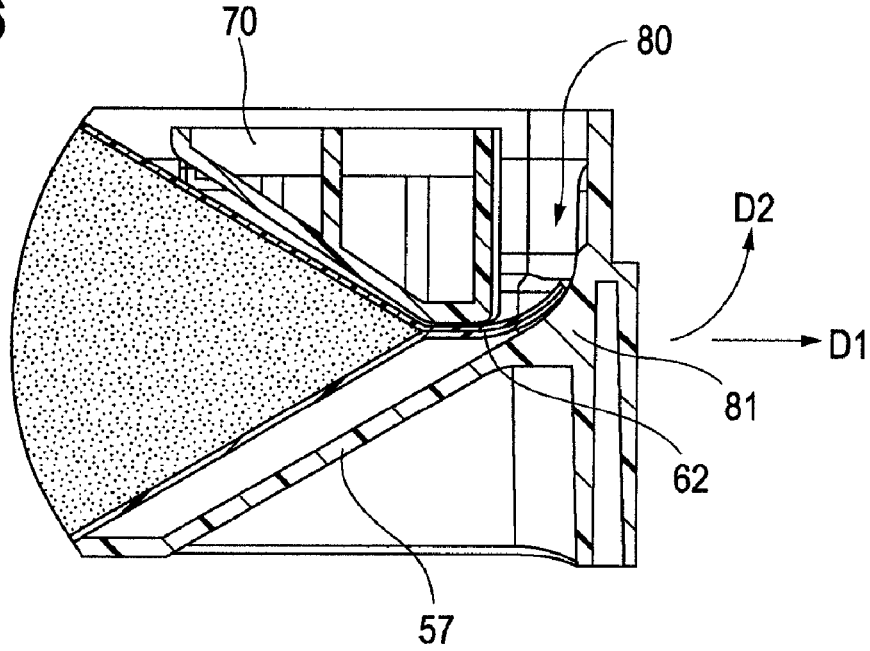
FIG. 16 is an expanded view illustrating a XVI portion in FIG. 9.

In this embodiment, as shown in FIG. 16 which is an expanded view illustrating a XVI portion in FIG. 9, the reception portion 80 is designed to receive the displacement L shown in FIG. 15. That is, the second sealing joint portion 62 inserted into the gap between the spacer member 70 and the spacer protrusion 57 is guided not in a straight-forward direction (a first direction) D1, but in a second direction D2 intersecting the first direction D1 by a guide portion 81.

As long as the second direction D2 intersects the first direction D1, the second direction D2 may be one of a straight-forward direction, a curved direction, a bending direction in which plural straight-forward directions with a predetermined intersecting angle are combined, and a complex direction in which two or more of the directions are combined.

In this embodiment, as shown in FIG. 10, the guide portion 81 is formed by a plurality of guide ribs 81*a* connecting the spacer protrusion 57 to the peripheral wall 52.

In this embodiment, in FIG. 16, when the ink pack 60 is mounted in the lower case 42, the second sealing joint portion 62 is wound or curved by the guide portion 81 (the guide ribs 81*a*). Accordingly, when the second sealing joint portion 62 is displaced upon leading the ink from the ink pack 60, the second sealing joint portion 62 smoothly enters the reception portion 80 between the spacer member 70 and the peripheral wall 52. In addition, the pressurizing air introduced into the pressurizing chamber 51 pushes the ink pack 60 to lead out the ink, and thus the second sealing joint portion 62 is smoothly received into the reception portion 80.

As described in FIG. 7, both the ends of the second sealing joint portion 62 are chamfered, and the width of the end of the first sealing joint portion 61 of the first edge is narrower than that of the end of the second sealing joint portion 62. Accordingly, movement resistance of the second sealing joint portion 62 is reduced, and thus smooth movement is guaranteed. In particular, since the second sealing joint portion 62 is sealed after filling of the ink, the burr is easily generated in both corners 62*e* and 62*f* shown in FIG. 7. Since the burr is cut, the movement resistance of the second sealing joint portion 62 is further reduced.

In this way, all the ink contained in the ink pack 60 can be led out while the second sealing joint portion 62 is smoothly displaced.

In particular, since the reception portion 80 is disposed in a dead space between the spacer member 70 and the peripheral wall 52, the displacement of the second sealing joint portion 62 can be absorbed using the dead space in a state the lower case 42 has the present size.

Figure 17A:
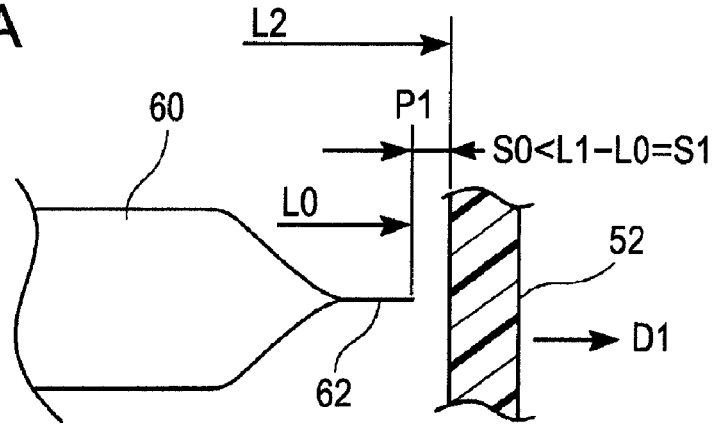
FIGS. 17A and 17B are schematic views for explaining first and second inequalities.
Figure 17B:
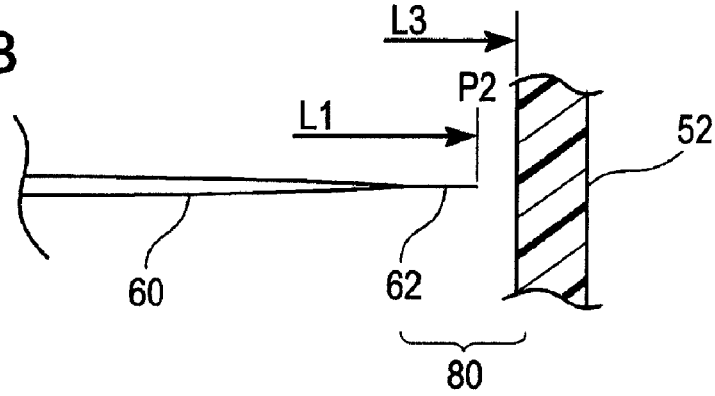

FIGS. 17A and 17B are diagrams for explaining the reason for providing the reception portion 80 and the guide portion 81. FIG. 17A shows an example in which a small gap is formed between the second sealing joint portion 62 and the peripheral wall 52, similarly to FIGS. 4 and 8 in JP-A-2002-19136. In this embodiment, since the ink lead-out member 63 disposed in the front end of the ink pack 60 is supported by the fixing ribs 58, the position thereof cannot be changed. As shown in FIG. 17A, a distance between a reference position such as the fixing rib 58 and a rear end position P1 of the second sealing joint portion 62 is assumed to be L0 in a state in which the ink pack 60 is full of ink. As shown in FIG. 17B, a distance between the reference position and a rear end position P2 of the second sealing joint portion 62 is assumed to be L1 in a state in which the ink pack 60 is empty. As shown in FIG. 17A, a distance between the reference position and the peripheral wall 52 in the rear edge is assumed to be L2. At this time, in a state of L0<L2<L1 (a first inequality), the rear end of the second sealing joint portion 62 collides the peripheral wall 52 in course of the displacement, and thus the more displacement may be difficult. The above-described example is a known technique. Afterward, even though the pressurizing air is introduced into the pressurizing chamber 51, the second sealing joint portion 62 cannot be displaced, and the ink has to be led out. Accordingly, the ink pack 60 has to be pressurized and deformed without the displacement of the second sealing joint portion 62. Therefore, suppressing the displacement of the second sealing joint portion 62 hinders the pressurization and deformation of the ink pack 60.

FIG. 17B shows an example in which the reception portion 80 is formed between the rear end position P1 of the second sealing joint portion 62 before the displacement and the peripheral wall 52. In this case, since the reception portion 80 guarantees the displacement of the second sealing joint portion 62 until the rear end position P2, the pressurization and deformation of the ink pack 60 is not hindered.

However, in FIG. 17B, a length size of the lower case 42 has to be longer by L shown in FIG. 15. Accordingly, the above-described guide portion 81 guides the second sealing joint portion 62 in the second direction D2 intersecting the first direction D1 so as to be wound or curved. For example, the lower case 42 is not required to be longer by permitting the peripheral wall 52 to be provided at the position shown in FIG. 17A.

In FIGS. 17A and 17B, the following definition is possible. As shown in FIG. 17A, a distance between a reference position P1 at which the end of the second sealing joint portion 62 is positioned and the wall portion of the case positioned at the end in the first direction D1 is assumed to be S0 in the ink pack 60 before the liquid of the ink pack 60 is led out. Accordingly, S0=L2−L0 is satisfied. As shown in FIG. 17B, a movement distance from the reference position P1 in the second direction D2 is assumed to be S1 (S1=L1−L0) in the ink pack 60 after all the liquid of the ink pack 60 is substantially led out. FIG. 17B shows the displacement in the first direction D1. However, as shown in FIG. 16, it is apparent that the displacement is equal to the movement distance S1 in the second direction D2. Using the above-described S0 and S1, S0<S1 (a second inequality) is satisfied by providing the guide portion 81. That is, the movement of the second sealing joint portion 62 can be permitted by the movement distance S2 which is longer than S0 between the reference position P1 and the faced wall.

The first and second inequalities are also satisfied in an example in which the reception portion is formed for the sealing adhesion of the second edge opposite the first edge in which the ink lead-out member 63 is disposed in the above-described pillow type ink pack.

The second inequality is satisfied in an example in which the reception portion is formed for the sealing joint portion of two second edges perpendicular to the first edge in which the ink lead-out member 63 is disposed in the above-described pillow type ink pack. Since the second edges in which the ink lead-out member 63 is supported are not the reference position, the first inequality is not satisfied. However, the second inequality in which the end of the second sealing joint portion 62 is the reference position is satisfied.

Modified Embodiment of Reception Portion

Figure 18:
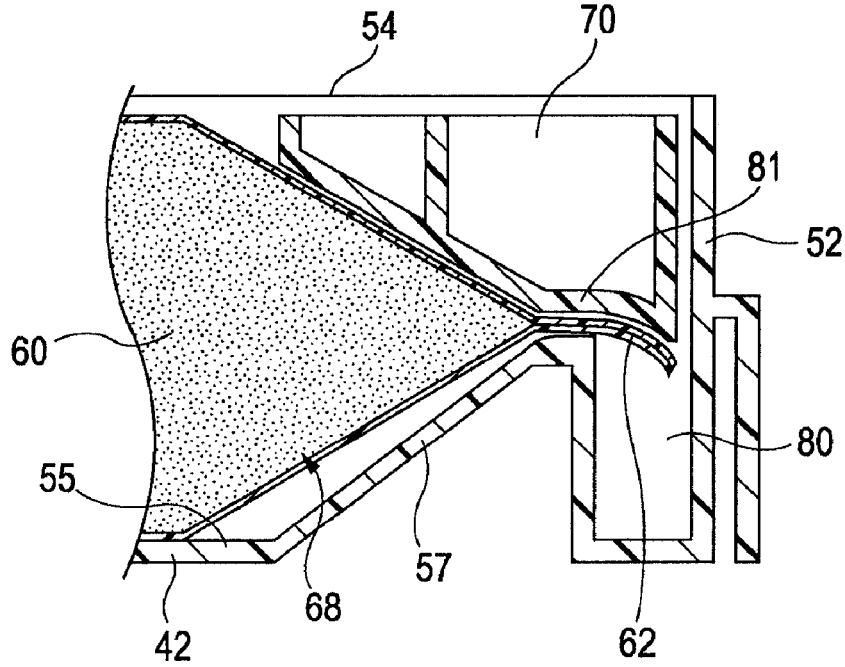
FIG. 18 is a sectional view illustrating a modified example in which a dead space between a spacer protrusion and a peripheral wall is configured to be a reception portion.
Figure 19:
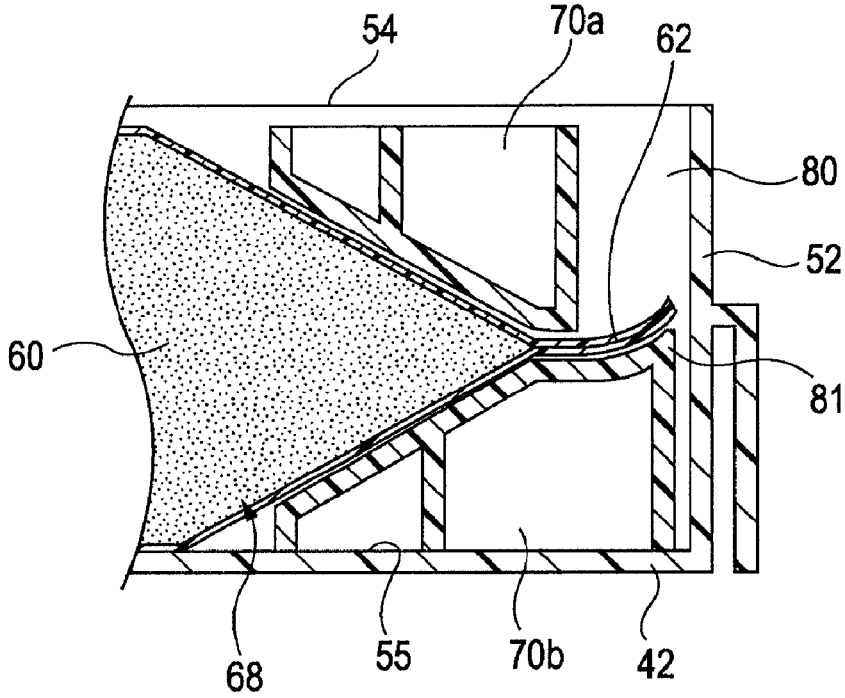
FIG. 19 is a sectional view illustrating a modified example in which first and second spacer members are provided in upper and lower portions of an ink pack and a dead space between the first spacer member and a peripheral wall is configured to be a reception portion.
Figure 20:
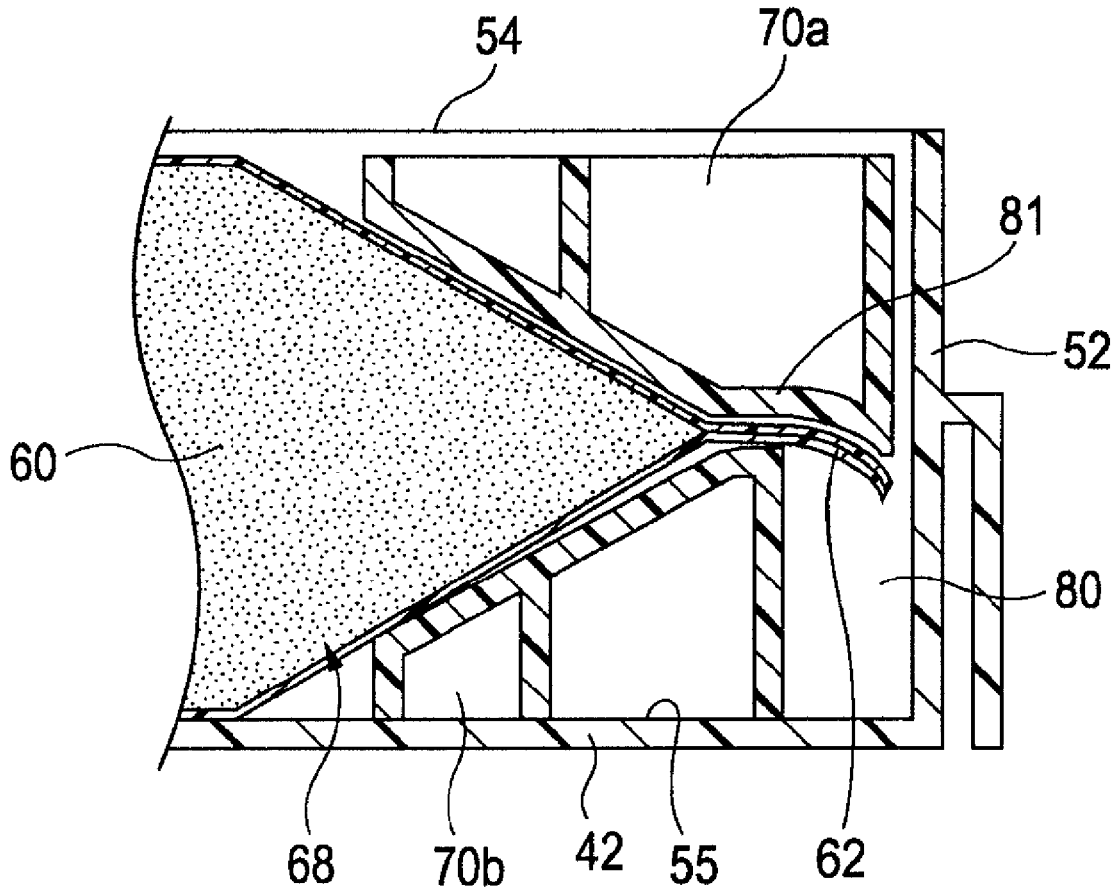
FIG. 20 is a sectional view illustrating a modified example in which in which first and second spacer members are provided in upper and lower portions of an ink pack and a dead space between the second spacer member and a peripheral wall is configured to be a reception portion.

Modified embodiments of the reception portion 80 are shown in FIGS. 18 to 20. In FIG. 18, the reception portion 80 is formed in the dead space between the spacer protrusion 57 protruding from the bottom wall 55 of the lower case 42 toward the second sealing joint portion 62 and the thickness varying area 68 and the peripheral wall 52 opposite the spacer protrusion 57. In this case, the guide portion 81 for guiding the second sealing joint portion 62 into the reception portion 80 is provided in the spacer member 70, which is disposed not in the second sealing joint portion 62 and the thickness varying area 68, but in the opening of the lower case 42, and is fixed to the lower case 42.

In FIGS. 19 and 20, there is provided a first spacer member 70*a* disposed not in the second sealing joint portion 62 and the thickness varying area 68, but in the opening of the lower case 42 are not provided. In addition, there is provided a second spacer member 70*b* disposed not in the second sealing joint portion 62 and the thickness varying area 68, but on the bottom wall 55 of the lower case 42. The first spacer member 70*a* and the second spacer member 70*b* are all positioned in the lower case 42.

In FIG. 19, the reception portion 80 is formed in a dead space between the peripheral wall 52 and the first spacer member 70*a*. In this case, the second sealing joint portion 62 can be guided to the reception portion 80 by a guide portion 81 provided in the second spacer member 70*b*. Conversely, in FIG. 20, the reception portion 80 is formed in a dead space between the peripheral wall 52 and the second spacer member 70*b*. In this case, the second sealing joint portion 62 can be guided to the reception portion 80 by a guide portion 81 provided in the first spacer member 70*a*.

Refilling Method

The above-described ink cartridge 9 can be reused. After the ink is led out from in the ink pack 60, a liquid can be refilled into the ink pack 60 through the ink lead-out member 63.

As shown in FIG. 5, the ink cartridge 9 according to this embodiment is provided with the ink level detecting unit 53. In the following description, the ink level detecting unit 53 is detached to refill ink. In addition, the following refilling method can be also applied to an ink cartridge having no ink level detecting unit 53. The refilling of ink is possible with the ink level detecting unit 53 attached. In this case, an ink injecting needle described below is inserted into the ink lead-out port 43 shown in FIG. 3.

First, the ink injecting needle (not shown) is inserted into the ink lead-out member 63 and a valve mechanism mounted in the ink lead-out member 63 is operated to prepare to refill the liquid into the ink pack 60. There are known the valve mechanism mounted in the ink lead-out member 63 and a needle instrument for operating the valve mechanism which are disclosed in, for example, JP-A-2006-312332.

Figure 21A:
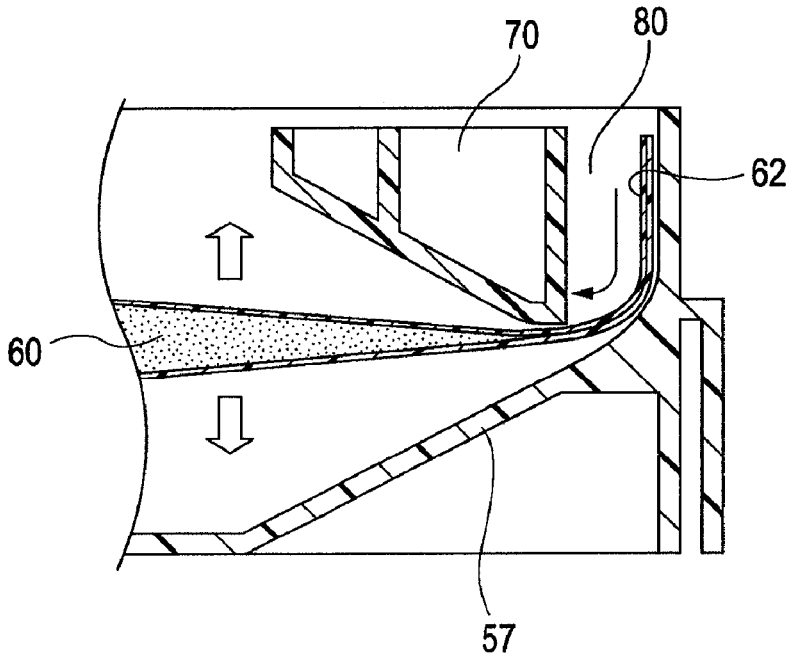
FIGS. 21A and 21B are schematic sectional views for explaining a refilling method according to the invention.
Figure 21B:
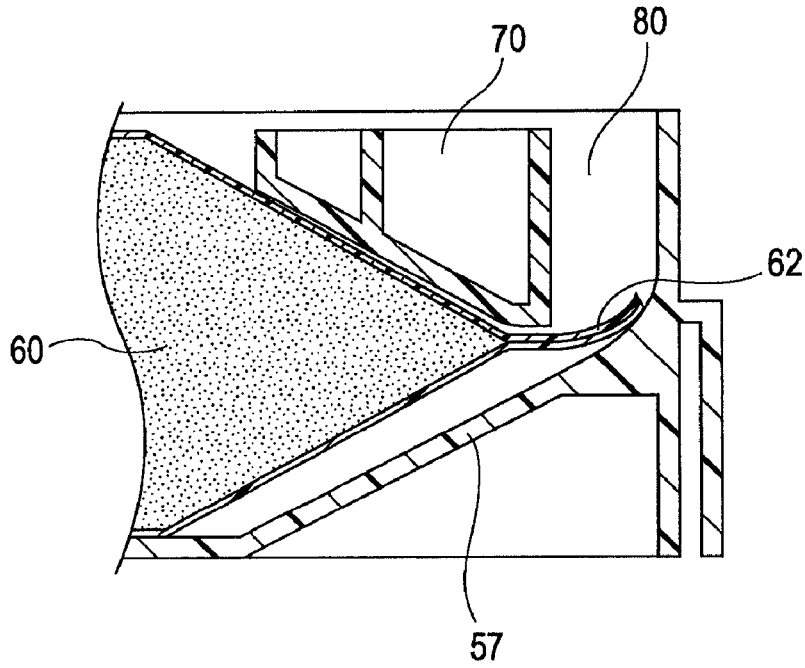

Next, the ink pack 60 is refilled with a liquid through the ink injecting needle. In this case, as shown in FIG. 21A, the second sealing joint portion 62 received in the reception portion 80 is displaced in accordance with expansion of the ink pack 60 in order to return the second sealing joint portion 62 to the inner side of the lower case 42 closer than the reception portion 80 before the refilling starts. Finally, as shown in FIG. 21B, when the refilling of the liquid into the ink pack 60 is completed, the second sealing joint portion 62 is returned to the position shown in FIG. 16. Accordingly, when the ink cartridge 9 is repeatedly reused, the second sealing joint portion 62 can be received in the reception portion 80 at the time of leading out the ink. The refilling can be completely performed in the embodiment in FIGS. 18 to 20. In particular, in the refilling, the second sealing joint portion 62 shown in FIGS. 21A and 21B can be smoothly guided by the guide portion 81 by providing the guide portion 81.

The reception portion 80 and the guide portion 81 are useful not only in the leading out of the ink, but also in the refilling of the ink. Moreover, they do not hinder the movement of the second sealing joint portion 62 when the ink pack 60 is expanded or contracted.

The foregoing description is completely the same in a case in which the ink injecting needle is inserted into the ink lead-out port 43 in FIG. 4. That is because the ink discharging member of the ink level detecting unit 53 is disposed at a position opposite the ink lead-out port 43. Accordingly, the ink injecting needle operates the valve mechanism provided in the ink discharging member of the ink level detecting unit 53. In the ink lead-out member 63 of the ink pack 60, the valve mechanism of the ink level detecting unit 53 is opened by a connection needle. Accordingly, there is no difference except that the connection needle is inserted through the ink level detecting unit 53, and the refilling is possible through the ink level detecting unit 53.

Modified Embodiment

It is apparent to a person skilled in the art that the above-described embodiment may be modified in various forms without departing from the novelty and advantages of the invention. Accordingly, such modification examples include the scope of the invention. For example, in the specification and the drawings, terminologies described with other terminologies having the same meaning or the broader meaning at least once may be substituted in any portion of the specification and drawings.

The liquid storage container according to the invention is not limited to the ink cartridge of the ink jet printing apparatus. Various liquid consuming apparatus having the liquid ejecting head can be useful.

As the liquid consuming apparatus having the liquid ejecting head, an apparatus having a color material ejecting head used to manufacture a color filter such as a liquid crystal display, an apparatus having an electrode material (conductive paste) ejecting head used to form electrodes such as an organic EL display or a field emission display (FED), an apparatus having a bio-organic matter ejecting head used to manufacture a bio-chip, an apparatus having a sample ejecting head as a precise pipette, a printing apparatus, and a micro dispenser can be exemplified.

What is claimed is:

1. A liquid storage container comprising:

a liquid storage bag which at least includes first and second sealing joint portions obtained by joining flexible members in a sealing manner;

a liquid lead-out member which is mounted on the first sealing joint portion of the liquid storage bag;

a case which holds the liquid storage bag and the liquid lead-out member and supports the liquid lead-out member; and a reception portion which is formed in the case to receive the second sealing joint portion displaced when a liquid is led out from the liquid storage bag.

2. The liquid storage container according to claim 1, wherein assuming that in a state in which the reception portion is not present, a direction in which the second sealing joint portion with a straight line shape is displaced in an extension line of the second sealing joint portion is a first direction and a direction intersecting the first direction is a second direction, the reception portion has a guide portion for guiding the second sealing joint portion in the second direction.

3. The liquid storage container according to claim 1, wherein the reception portion has a guide portion for guiding the second sealing joint portion in a second direction other than a first direction which is a straight-forward direction.

4. The liquid storage container according to claim 3, wherein the second direction is one of a straight-forward direction, a curved direction, a bending direction in which plural straight lines with a predetermined intersecting angle are combined, and a complex direction in which two or more of the directions are combined.

5. The liquid storage container according to claim 3, wherein in a state in which the liquid is not led out from the liquid storage bag, the second sealing joint portion is bent or curved while making abutting contact with the guide portion.

6. The liquid storage container according to claim 3, wherein the liquid storage bag is formed in a rectangular shape in plan view, and wherein the second sealing joint portion is formed in a second edge opposite a first edge in which the first sealing joint portion is formed.

7. The liquid storage container according to claim 6, wherein assuming that in a state in which the liquid is not led out from the liquid storage bag, a distance between a support position of the liquid lead-out member of the liquid storage bag and a rear end of the second sealing joint portion of the liquid storage bag is L0; in a state in which the liquid is substantially led out from the liquid storage bag, a distance between the support position and the rear end of the second sealing joint portion of the liquid storage bag is L1; and a distance between the support position and an inner wall surface of the case facing the rear end of the second sealing joint portion is L2, a relation of L0<L2<L1 is satisfied.

8. The liquid storage container according to claim 3, wherein the second sealing joint portion is formed in a second edge intersecting a first edge in which the first sealing joint portion is formed.

9. The liquid storage container according to claim 3, wherein assuming that in a state in which the liquid of the liquid storage bag is led out from the liquid storage bag, a distance between a reference position at which an end of the second sealing joint portion is positioned and a wall portion of the case disposed at the end of the first direction is S0, and in a state in which the liquid is substantially completely led out from the liquid storage bag, a movement distance that the end of the second sealing joint portion has moved in the second direction from the reference position is S1, a relation of S0<S1 is satisfied.

10. The liquid storage container according to claim 6, wherein the flexible member includes first to third flexible member, and wherein the second sealing joint portion is formed by joining the first to third flexible members in such a manner that the third flexible member bent in a bending line is disposed between the first and second flexible members, the first to third flexible members are joined together in a sealing manner on the bending line of the third flexible member, whereby the opposing surfaces of the first and third flexible members are joined together in a sealing manner and the opposing surfaces of the second and third flexible members are joined together in a sealing manner.

11. The liquid storage container according to claim 10, wherein both corners of the second edge are cut in areas in which the opposing surfaces of the first and third flexible members are joined together in a sealing manner and the opposing surfaces of the second and third flexible members are joined together in a sealing manner, wherein the length of the second edge is shorter than that of the first edge.

12. The liquid storage container according to claim 3, further comprising:

a spacer member which is disposed in the opening of the case closer than the second sealing joint portion and the thickness varying area and supported by the case; and a spacer protrusion which protrudes from the bottom wall of the case toward the second sealing joint portion and the thickness varying area, wherein the case includes a bottom wall, a peripheral wall, and an opening, the bottom wall and the peripheral wall forming a concave portion for holding the liquid storage bag and the liquid lead-out member, wherein the liquid storage bag has a thickness varying area of which the thickness varies from the second sealing joint portion to the center thereof, wherein the spacer member includes an opposing surface opposite the peripheral wall, wherein the reception portion includes a dead space between the peripheral wall and the opposing surface of the spacer member, and wherein the spacer protrusion includes the guide portion which guides the second sealing joint portion to the reception portion.

13. A method of refilling a liquid into the liquid storage bag of the liquid storage container according to claim 12, through the liquid lead-out member after the liquid storage bag is led out, the method comprising:

inserting a liquid injecting needle into the liquid lead-out member and operating a valve mechanism mounted in the liquid lead-out member to refill the liquid into the liquid storage bag;

refilling the liquid into the liquid storage bag through the liquid injecting needle; and displacing the second sealing joint portion received in the reception portion along the guide portion in accordance with expansion of the liquid storage bag before starting the refilling to return the second sealing joint portion to the inside of the case closer than the reception portion.

14. The liquid storage container according to claim 3, further comprising:

a spacer member which is disposed in the opening of the case closer than the second sealing joint portion and the thickness varying area and supported by the case; and a spacer protrusion which protrudes from the bottom wall of the case toward the second sealing joint portion and the thickness varying area, wherein the case includes a bottom wall, a peripheral wall, and an opening, the bottom wall and the peripheral wall forming a concave portion for holding the liquid storage bag and the liquid lead-out member, wherein the liquid storage bag has a thickness varying area of which the thickness varies from the second sealing joint portion to the center thereof, wherein the spacer protrusion includes an opposing surface opposite the peripheral wall, wherein the reception portion includes a dead space between the peripheral wall and the opposing surface of the spacer member, and wherein the spacer member includes the guide portion which guides the second sealing joint portion to the reception portion.

15. The liquid storage container according to claim 3, further comprising:

a first spacer member which is disposed in the opening of the case closer than the second sealing joint portion and the thickness varying area and supported by the case; and a second spacer member which is disposed in the opening of the case closer than the second sealing joint portion and the thickness varying area and supported by the case, wherein the case includes a bottom wall and a peripheral wall which form a concave portion for holding the liquid storage bag and the liquid lead-out member, wherein the liquid storage bag has a thickness varying area of which the thickness varies from the second sealing joint portion to the center thereof, wherein the first spacer member includes an opposing surface opposite the peripheral wall, wherein the reception portion includes a dead space between the peripheral wall and the opposing surface of the first spacer member, and wherein the second spacer member includes the guide portion which guides the second sealing joint portion to the reception portion.

16. The liquid storage container according to claim 3, further comprising:

a first spacer member which is disposed in the opening of the case closer than the second sealing joint portion and the thickness varying area and supported by the case; and a second spacer member which is disposed in the opening of the case closer than the second sealing joint portion and the thickness varying area and supported by the case, wherein the case includes a bottom wall and a peripheral wall which form a space for holding the liquid storage bag and the liquid lead-out member, wherein the liquid storage bag has a thickness varying area of which the thickness varies from the second sealing joint portion to the center thereof, wherein the second spacer member includes an opposing surface opposite the peripheral wall, wherein the reception portion includes a dead space between the peripheral wall and the opposing surface of the second spacer member, and wherein the first spacer member includes the guide portion which guides the second sealing joint portion to the reception portion.

17. A method of refilling a liquid into the liquid storage bag of the liquid storage container according to claim 3 through the liquid lead-out member after the liquid storage bag is led out, the method comprising:

inserting a liquid injecting needle into the liquid lead-out member and operating a valve mechanism mounted in the liquid lead-out member to refill the liquid into the liquid storage bag;

refilling the liquid into the liquid storage bag through the liquid injecting needle; and displacing the second sealing joint portion received in the reception portion along the guide portion in accordance with expansion of the liquid storage bag before starting the refilling to return the second sealing joint portion to the inside of the case closer than the reception portion.

18. The liquid storage container according to claim 1, wherein the case includes a bottom wall, a peripheral wall, and an opening, the bottom wall and the peripheral wall forming a concave portion for holding the liquid storage bag and the liquid lead-out member, wherein the liquid storage bag has a thickness varying area of which the thickness varies from the second sealing joint portion to the center thereof, wherein a spacer member is disposed closer to the opening of the case than the second sealing joint portion and the thickness varying area and supported by the case, wherein the spacer member includes an opposing surface opposite the peripheral wall, and wherein the reception portion includes a dead space between the peripheral wall and the opposing surface of the spacer member.

19. The liquid storage container according to claim 1, wherein the case includes a bottom wall and a peripheral wall which form a concave portion for holding the liquid storage bag and the liquid lead-out member, wherein the liquid storage bag has a thickness varying area of which the thickness varies from the second sealing joint portion to the center thereof, wherein the case includes a spacer protrusion protruding from the bottom wall toward the second sealing joint portion and the thickness varying area, wherein the spacer protrusion includes an opposing surface opposite the peripheral wall, and wherein the reception portion includes a dead space between the peripheral wall and the opposing surface of the spacer protrusion.

20. The liquid storage container according to claim 1, wherein the case includes a bottom wall and a peripheral wall which form a concave portion for holding the liquid storage bag and the liquid lead-out member, wherein the liquid storage bag has a thickness varying area of which the thickness varies from the second sealing joint portion to the center thereof, wherein a spacer member is disposed in the bottom wall of the case closer than the second sealing joint portion and the thickness varying area and supported by the case is provided, wherein the spacer member includes an opposing surface opposite the peripheral wall, and wherein the reception portion includes a dead space between the peripheral wall and the opposing surface of the spacer member.

21. The liquid storage container according to claim 1, further comprising a sealing film which seals the case to form a pressurizing chamber capable of introducing a pressurizing liquid into the case.

22. The liquid storage container according to claim 1, further comprising:

a liquid level detecting unit which is connected to the liquid lead-out member, wherein the liquid level detecting unit includes a connection needle inserted into the liquid lead-out member and a liquid discharging member for discharging a liquid led out from the connection needle, and wherein the liquid level detecting unit detects an amount of remaining liquid between the connection needle and the liquid discharging member.

23. A method of refilling a liquid into the liquid storage bag of the liquid storage container according to claim 22 through the liquid level detecting unit and the liquid lead-out member after the liquid storage bag is led out, the method comprising:

inserting a liquid injecting needle into the liquid discharging member of the liquid level detecting unit and operating a valve mechanism mounted in the liquid discharging member to refill the liquid into the liquid storage bag;

refilling the liquid into the liquid storage bag through the liquid injecting needle and the liquid level detecting unit; and displacing the second sealing joint portion received in the reception portion in accordance with expansion of the liquid storage bag before starting the refilling to return the second sealing joint portion to the inside of the case closer than the reception portion.

24. A method of refilling a liquid into the liquid storage bag of the liquid storage container according to claim 1 through the liquid lead-out member after the liquid storage bag is led out, the method comprising:

inserting a liquid injecting needle into the liquid lead-out member and operating a valve mechanism mounted in the liquid lead-out member to refill the liquid into the liquid storage bag;

refilling the liquid into the liquid storage bag through the liquid injecting needle; and displacing the second sealing joint portion received in the reception portion in accordance with expansion of the liquid storage bag before starting the refilling to return the second sealing joint portion to the inside of the case closer than the reception portion.

25. The liquid storage container according to claim 1, wherein the reception portion is a space between a spacer member and a peripheral wall of the case.

26. A method of leading out liquid from a liquid storage bag held in a case, comprising:

storing a liquid in a liquid storage bag which at least includes first and second sealing joint portions obtained by joining flexible members in a sealing manner; and pushing the ink storage bag to lead out the liquid through a liquid lead-out member which is mounted on the first sealing joint portion of the liquid storage bag, wherein when the liquid is led out from the liquid storage bag, the second sealing joint portion is displaced and is received in a reception portion formed between a spacer member and a peripheral wall of the case.

* * * * *